US011623322B2

(12) United States Patent
Alberti

(10) Patent No.: US 11,623,322 B2
(45) Date of Patent: Apr. 11, 2023

(54) GRINDER TOOL WITH BLIND MOUNTING OF A DISC

(71) Applicant: John Alberti, Corvallis, OR (US)

(72) Inventor: John Alberti, Corvallis, OR (US)

( * ) Notice: Subject to any disclaimer, the term of this patent is extended or adjusted under 35 U.S.C. 154(b) by 682 days.

(21) Appl. No.: 16/515,845

(22) Filed: Jul. 18, 2019

(65) Prior Publication Data

US 2020/0023488 A1 Jan. 23, 2020

Related U.S. Application Data

(60) Provisional application No. 62/700,286, filed on Jul. 18, 2018.

(51) Int. Cl.
*B24B 45/00* (2006.01)
*B24B 41/00* (2006.01)

(52) U.S. Cl.
CPC ..... *B24B 45/00* (2013.01); *B24B 41/005* (2013.01)

(58) Field of Classification Search
None
See application file for complete search history.

(56) References Cited

U.S. PATENT DOCUMENTS 388,672 A * 8/1888 Hall ..... B24B 41/066 451/410
3,771,267 A * 11/1973 Fortunski ..... B24B 41/068 451/411
4,259,814 A * 4/1981 Glaser ..... B24B 3/00 451/280
4,305,231 A * 12/1981 Rasmussen ..... B24B 27/0076 451/65
4,562,670 A * 1/1986 Maier ..... B23Q 1/4804 451/340
4,566,511 A * 1/1986 Robinson ..... B27C 9/005 144/48.5
4,574,530 A * 3/1986 Handler ..... B24B 23/02 451/340
4,924,633 A * 5/1990 Hock ..... B24B 21/18 D15/124
5,199,220 A * 4/1993 Steiner ..... B24B 21/008 451/65
6,139,411 A * 10/2000 Everts ..... B24B 23/005 451/451
7,044,841 B1 * 5/2006 Liao ..... B24B 55/08 451/67
2011/0296968 A1 * 12/2011 Doumani ..... B23D 59/005 83/468.2
2016/0339557 A1 * 11/2016 Starnes ..... B24B 3/605

* cited by examiner

*Primary Examiner* — Joseph J Hail
*Assistant Examiner* — Dana Lee Poon
(74) *Attorney, Agent, or Firm* — Michael Dryja

(57) ABSTRACT

A grinder tool with blind mounting of a disc includes a center alignment mechanism having a first contact and a second contact and a rotational device including an axle that is movable with respect to the center alignment mechanism. A hub is mounted to the axle including a first coupling interface. The disc has a second coupling interface for mating with the first coupling interface. The center alignment mechanism is movable a mounting distance relative to the hub and contacts the disc with the first contact and the second contact to center align the first coupling interface with the second coupling interface. The rotational device is to slowly rotate the hub to angle align the first coupling interface with the second coupling interface to allow the disc to mate and attach to the hub.

23 Claims, 23 Drawing Sheets

DETAIL A

DETAIL A

GRINDER TOOL WITH BLIND MOUNTING OF A DISC

RELATED APPLICATIONS

Benefit of Priority

This application claims priority of U.S. Provisional Patent Application No. 62/700,286 filed on Jul. 18, 2018, entitled "GRINDER TOOL WITH BLIND MOUNTING OF A DISC", the disclosure of which is hereby incorporated by reference.

Incorporation by Reference

This application is related to PCT Application Number PCT US2014/029559, filed Mar. 15, 2013, entitled "FORCE RESPONSIVE POWER TOOL" and its US National Stage Entry application Ser. No. 14/769,027, filed Mar. 14, 2014, entitled "FORCE RESPONSIVE POWER TOOL, now published as US20160001411A1, all of which are hereby incorporated by reference in their entirety.

BACKGROUND

Craftsmen such as carpenters, instrument makers, and tool sharpeners have used grinder tools to trim material from work objects, such as wood, metal, chisels, tools, and the like. When doing so, safety is always a primary concern. The method in which grinding discs are attached to the grinder tool impact how well the craftsmen can approach a work object to the gritted surface. Also, depending on the desired task, the angle of the work object, the direction of the grinding surface, and the ability to remove waste material all affect the final outcome. It is desirable to have as much flexibility as possible in configuring a work environment while maintaining safety.

BRIEF DESCRIPTION OF THE DRAWINGS

The disclosure is better understood with reference to the following drawings. The elements of the drawings are not necessarily to scale relative to each other. Rather, the emphasis has instead been placed upon clearly illustrating the claimed subject matter. Furthermore, like reference numerals designate corresponding similar parts through the several views. For conciseness, referenced items appearing in later drawings may not be repeated. In some instances, multiple drawings may be discussed as a group to avoid repetition.

DETAILED DESCRIPTION

Figure 1A:
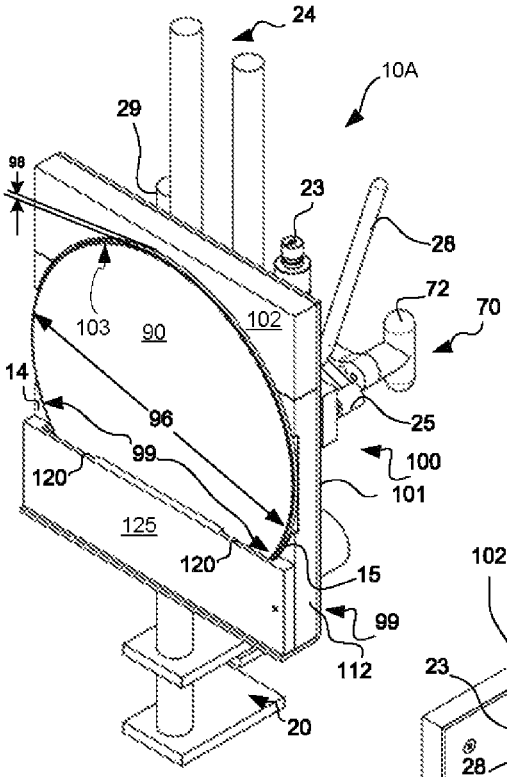
FIGS. 1A and 1B are front and rear perspective views, respectively, of an example grinder tool with a hand crank rotational device.

The disclosed example grinder tools and accessories are versatile and allow for improved productivity, accurate control, and improved safety. In the past, a portion of a sanding or grinding abrasive disc surface was removed to allow a user to visibly attach the disc to a grinder tool. As described in this disclosure, by providing a blind mounting technique, the entire surface of the disc may be used for the abrasive surface. The blind mounting mechanism for a grinder tool may include a center alignment mechanism having a first contact and a second contact. A rotational device may include an axle that is movable with respect to the center alignment mechanism. A hub may be mounted to the axle and may include a first coupling interface. The disc may have a second coupling interface for mating with the first coupling interface. The center alignment mechanism may be movable a first mounting distance relative to the hub and may contact the disc with the first contact and the second contact to center align the first coupling interface with the second coupling interface. The rotational device may be configured to slowly rotate the hub to angle align the first coupling interface with the second coupling interface to thus allow the disc to mate and attach to the hub.

There are at least three main mechanical portions of the example grinder and accessories: (1) a set of segments in a backplate (or more generally a plate) surrounding the grinder disc that are used for loading the disc and that also may be used for vacuuming particles from sanding operations; (2) multiple fences used with a work table to allow positioning of work articles at various angles to the grinder tool; and (3) a tool holder for sharpening woodworking or other hand tools.

The backplate may be comprised of the set of segments and may be attached to a motor or a hand crank with a magnetic or another attachment hub that holds a sanding or grinding disc. To allow a disc to be easily mounted and unmounted, there may be adaptions to the back plate to allow for movement between the disc and the hub. A semi-circular top segment may be used to encircle the disc partially. A partial-circular bottom segment partially may encircle the disc but may be movable towards the hub a short mounting distance to allow the disc when resting in the bottom segment partial-circle to align a center protrusion in the hub with a center hole in the disc. The hub may also have a set of one or more satellite protrusions to align with a set of one or more corresponding holes in the sanding disc. A motor or hand crank may be slowly rotated until the hub satellite protrusions align with the holes in the disc, thereby allowing the disc to "snap" flatly onto the hub. With a motor, the slow rotation may be done via a special 'mounting mode' routine in a motor controller and may be activated by a user. With a hand crank, the user may just rotate the hub with the hand crank slowly.

The top segment and bottom segment may have recessed cavities to allow waste material from a work object or grinding disc to be vacuumed and collected by a vacuum system.

The backplate may have a ledge that prevents the disc from being tilted and accidentally removed when force is applied to it during grinding. To aid in removal of the disc, a demounting lever may be attached to the back plate to allow the disc to tip out and break the coupling with the hub and thus allow a user to grab the disc easily.

A work table accessory may be attached to the grinder tool, and the work table may be adjustable at different angles and movable in an in/out direction. Various fence accessories may be used to adjust the working angle of work items to the disc surface. A first fence accessory may have a dual clamp that allows clamping the fence to the front or side of the work table with a first clamp while also allowing a second clamp to clamp a working guide at various angles and in/out to the disc surface. The second clamp may be reversible to allow for different thicknesses of work guides to be used. A second fence accessory may have magnets to allow attachment to the front or sides of the work table and magnets in the work guide to allow for holding the work guide to the surface of the work table during aligning, before being clamped down with a screw knob. Magnets may be added to the first fence as well.

A tool sharpening accessory may allow for various angles of attack in placing tool edge surfaces to the grinding disc. The tool sharpening accessory may be adjusted up/down and rotationally with respect to the sanding disc. The tool sharpening accessory may have a tool holder bar with multiple pins for holding the base of a tool during sharpening. The tool holder bar may be held in place with a special binding plate system that allows for adjusting the tool holder bar along up/down a pair of parallel rails that can also rotate the tool holder bar with respect to the plane of the sanding disc to change the angle of the grinding of the tool being sharpened. The mounting attachment points that hold the pair of parallel rails to the grinder tool are formed with a shaped opening to allow a tool that is to be sharpened, such as a long blade, to approach the disc surface from the sides of the grinder tool.

Accordingly, to improve the sharpening of tools, several different tool alignment mechanism accessories are shown and described herein. Further, to help improve productivity and safety, several integrative vacuum systems may also be incorporated to allow for the removal of work material and abrasive grit. More detailed information and examples follow within the detailed description of the drawings.

Figure 1B:
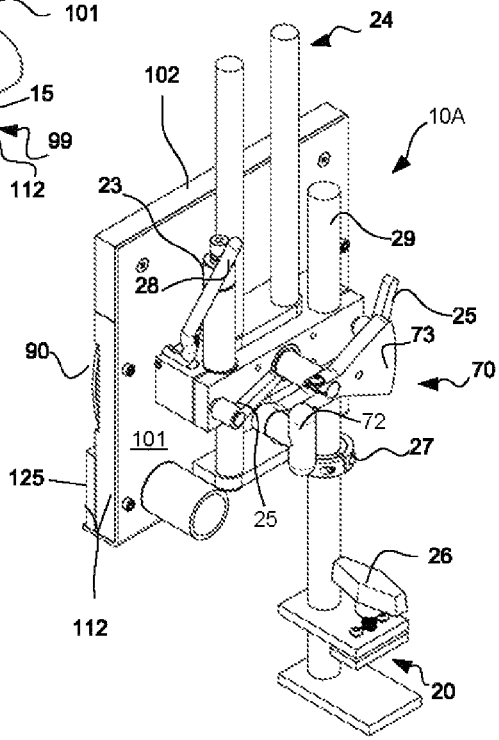
Figure 2:
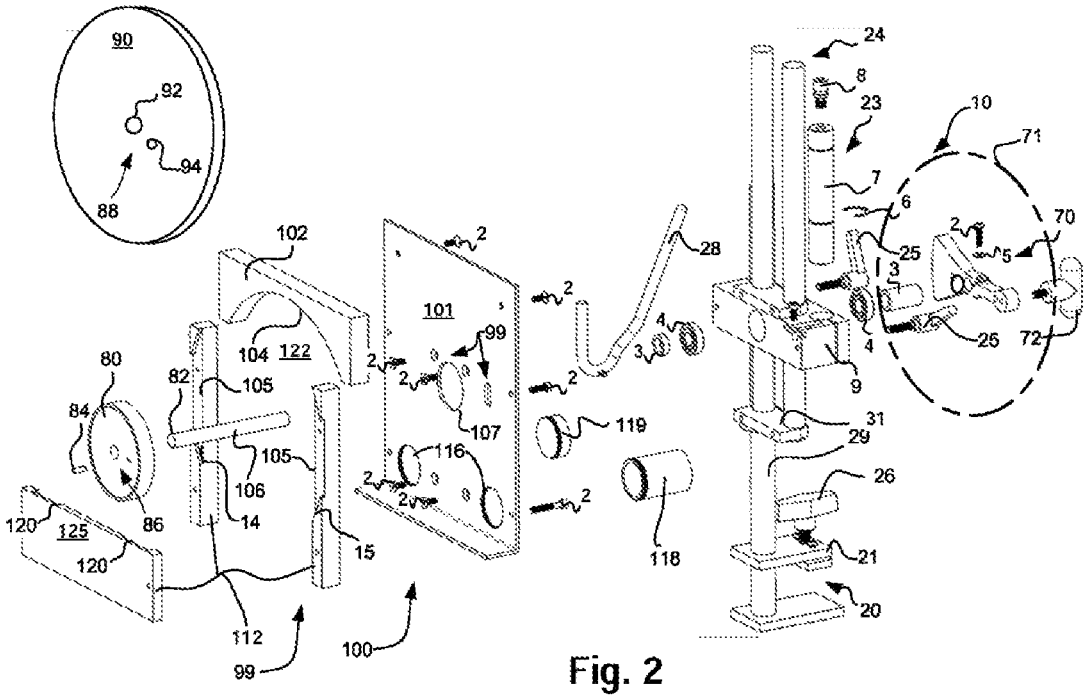
FIG. 2 is an exploded view of the example grinder tool shown in FIGS. 1A and 1B.

FIGS. 1A and 1B are front and rear perspective views, respectively, of an example manual grinder tool 10A having a rotational device 70 with a hand-crank 72. FIG. 2 is an exploded view of the example manual grinder tool 10A shown in FIGS. 1A and 1B with the backside of the disc 90 shown.

A rotational device 70, in this example a crank handle 72, is attached or otherwise mounted to a back plate 100 having a first segment opening. In other examples, such as shown in other figures, the rotational device 70 may be a brushless DC motor (BLDC) 74, an AC motor, a gearbox attached to a remote power unit, and the like. The rotational device 70 has an axle shaft the extends through the back plate 100 and is attached to a hub 80, preferably magnetic, on an opposing side of the back plate 100 from the rotational device 70.

If magnetic, the hub 80 may be a round-shaped aluminum disc with magnets inserted into or in some examples may be a magnetic material. In other examples, there may be multiple layers of non-magnetic and magnetic materials, such a carbon fiber or epoxy fiber as some example non-magnetic materials. The hub 80 may include a center protrusion 82 and a set of one or more satellite protrusions 84 surrounding the center protrusion 82 to form a first coupling interface 86.

With a magnetic hub 80, a disc 90 having a magnetic affinity is used for holding a grinding surface that covers its front side, and on its backside, has matching holes to align with the center protrusion 82 and the set of one or more satellite protrusions 84. The height of the center protrusion 82 and the set of one or more satellite protrusions 84 are less than the thickness of the disc 90 to ensure that the grinding surface, when attached to the front side of the disc 90, forms a substantially flat surface across the entire front surface of the disc 90. The magnetic affinity may be accomplished by using a disc 90 made of ferromagnetic material such as an iron or iron alloy material. Alternatively, the disc 90 may be made of a non-ferromagnetic material such as aluminum and embedded with iron or ferromagnetic material to allow the disc 90 to be magnetically attracted to a magnetic hub 80. Generally, a magnetic hub 80 may be made of a hard-magnetic material such as a neodymium or an alnico alloy (an iron alloy with aluminum, nickel, and cobalt) or another strong permanent magnet. Other strong permanent magnetic materials may include ferrite, a ceramic compound composed of iron oxide and other metallic elements. In some examples, a magnetic hub 80 may be designed to be an electromagnet that can be energized with electricity flowing through copper or aluminum wires surrounding a core made of iron, nickel, or cobalt.

The back plate 100 may be formed of a non-magnetic material such as aluminum, plastic, epoxy, ceramic, or other material and formed from a single or multiple pieces. The radius of the first segment 102 is greater than the radius of the disc 90. In some examples, the first segment 102 may not be truly circular but may be an elliptical or another shaped segment in which the opening is still sufficient to encompass a first portion of the disc 90 within.

A second segment 112 is mounted to the first segment 102 and has a second segment opening 114 (FIG. 7C) aligned with the first segment opening 104 to form a substantially circular opening having a diameter larger than the diameter of the disc 90. In some examples, the second segment opening 114 may not be truly circular but may be a partial, an elliptical, or another shaped segment in which the opening is still sufficient to encompass a second portion of the disc 90 within. Together, the first segment opening 104 and the second segment opening 114 form a substantially circular opening surrounding the hub 80 and allows for receiving the disc 90 when mounted on the hub 80. The second segment 112 may be made of a non-magnetic material such as aluminum, plastic, epoxy, ceramic, or other material. The second segment 112 may be made of the same or different material than the first segment 102.

With respect to blind mounting, as noted, the disc 90 has a diameter less than a diameter of the combined first 104 and second 114 segment openings. The disc 90 has a second coupling interface 88, for mating with first coupling interface 86 on the hub. Because the disc 90 is designed to have its front surface covered with grinding material, there is no visible human reference for where the second coupling interface openings are on the disc 90 when it is to be mounted to the hub 80. To help a user of the grinder tool reliably and safely mount the disc 90 onto the hub 80, a center alignment mechanism 99 allows the back plate 100 to be movable towards the hub 80 a mounting distance 98 such that the disc 90 when in contact with the second segment opening 114 at its first contact 14 and second contact 15, the disc 90 has a central opening of the second coupling interface 88 aligned with a center protrusion of the first coupling interface 86 formed in the hub 80. However, the set of satellite openings 94 in the disc 90 may not be aligned with a set of one or more satellite protrusions 84 on the magnetic hub 80. To help align the set of satellite openings 94 with the set of one or more satellite protrusions 84, the rotational device 70 is configured to rotate the hub 80 slowly to align the set of satellite openings 94 to the set of one or more satellite protrusions 84 on the hub 80.

When using a magnetic hub 80 and it is aligned with the disc 90, the disc 90 is magnetically attracted to the magnetic hub 80, and the disc 90 will "snap" to the magnetic hub 80 to allow the disc to magnetically mate to the magnetic hub 80. In some examples, the rotational device 70 is a crank handle 72. In these examples, a user can slowly rotate the crank handle 72 until the disc 90 snaps to the hub 80. In other examples, the rotational device 70 may be a motor 74. The motor 74 in these examples may include a "mounting mode" routine 78 such that when a button (not shown) is pressed (or initiated by other means) the motor 74 begins to rotate at a slow speed (for example, less than about 30 to 50 RPM) until and when the satellite openings 94 are aligned with the satellite protrusions 84 and the disc 90 snaps to the magnetic hub 80 and the motor 70 continues to rotate slowly until the mounting mode routine 78 is disabled, such as releasing the button (or disabled by other means). In some examples, slow speed may be set as a ratio such as 2%-5% or less of the full operating speed. Accordingly, by having a disc mounting system with the movable back plate 100 relative to the hub 80, and the ability to slowly rotate the hub 80, the disc 90 may be blind-mounted to the hub 80. This blind mounting feature allows the disc 90 to have its entire front surface be overlaid with grinding material and does not require a user to screw, bolt, clamp or otherwise mount the disc 90 onto the hub 80 as is done with most grinder tools. Once the disc 90 is mounted and mated to the hub 80, the back plate is allowed to move the mounting distance away from the hub 80 by gravity or other means.

In some examples, the back plate 100 may include a set of vacuum openings 116 that can be used to attach a vacuum or another waste material collector. The front cover 125 may include a first recessed channel 120 extending from the first 14 and second 15 contacts to the set of vacuum openings 116 to form a vacuum cavity when at least one of the set of vacuum openings 116 is coupled to a vacuum source. Accordingly, the first recessed channel 120 forms a vacuum cavity designed to balance airflow across the face of disc 90 and to collect and remove waste from the grinding surface of the disc 90 to the set of vacuum openings 116. In other examples, there may be an additional second recessed channel 122 in the back plate 100 extending around the first segment 102 and extending towards the first recessed channel 120 to extend the vacuum cavity to encompass the circumference of the disc 90 substantially.

To not require a large magnetic hub 80 and reduce mass as well as cost, a magnetic hub 80 is generally desired to have as small a diameter as needed to support the magnetic material and the center 82 and satellite 84 protrusions. However, having a small diameter hub may allow a user to apply a large force on the edge of the disc 90 and perhaps cause the disc 90 to de-mount from the magnetic hub 80. To prevent such an occurrence, back plate 100 may have a ledge 105 raised to be just below the back surface of the disc 90 once mounted onto the hub 80. With the ledge 105, a user is unable to tilt the disc 90 sufficiently to break the magnetic coupling with the magnetic hub 80 as it is prevented from further tilting once the back of the disc touches the surface of the ledge 105.

To remove the disc 90 once it has been mounted on or mated with the hub 80, the back plate 100 may have a demounting lever 28 attached to it. The demounting lever 28 may be biased in a first position where it does not touch the back side of the disc 90 and is movable by the user to a second position to tip the disc 90 by breaking the attraction between the disc 90 and the hub 80 and thus allow a user to grab the disc. When the user pulls the disc 90 away from the tool, the center protrusion 82 and the set of one or more satellite protrusions 84 on the hub 80 unmate from the center opening 92 and the set of satellite openings 94 in the disc 90.

The rotational device 70 is counterbalanced with a counterweighted crank arm 73. The rotational device 70 may be rotated clockwise or counter-clockwise at a speed determined by a user. The crank handle 72 in this example screws into a hole in a distal end of the counter-weight 73. The counterweight 73 is attached to an axle 106 and tightened with a screw 2 and washer 5. The counterweight 73 is positioned a distance from the manual grinder tool 10A with a spacer 3. The axle 106 rotates within a pair of bearings 4 that are mounted into an adjustment mount block 9. The adjustment mount block 9 is affixed to a set of guide rods 24 for vertical positioning of the manual grinder tool 10A. The adjustment mount block 9 may include an accessory attachment 23 with a mounting post 8 used to mount various accessories such as light sources, laser pointers, fans, etc. The set of guide rods 24 may be mounted to a first table mount 20. The table mount 20 may include a mount clamp knob 26 connected to a slip plate 21. The table mount 20 may be coupled to the set of guide rods 24 via a mounting rod 29 and a coupling plate 31.

The manual grinder tool 10A for a blind mounting a disc 90 may include a back plate 100 having a recessed opening 103 with first segment 102 and a second segment 112 with a first contact 14 and a second contact 15. The first segment 102 and the second segment 112 may be mounted together with screws 2 to a back-plate shield 101 or the first segment 102, the second segment 112 and the back-plate shield 101 may be a wholly formed solid piece or combination of several pieces.

The rotational device 70 includes the axle 106 and is movably mounted to the back plate 100, in this example to backplate shield 101. A magnetic hub 80 may be mounted to the axle 106 and may include a first coupling interface 86, shown here as a center protrusion 82 and a satellite protrusion 84 as just one example. The disc 90 may be ferromagnetic and has a disc diameter 96 less than a diameter of the recessed opening 103 and a second coupling interface 88 for mating with the first coupling interface 86. The second coupling interface 88 is shown here as a center opening 92, and a satellite opening 94 sized to accept the center protrusion 82 and the satellite protrusion 84, respectively. The back plate 100 is movable a mounting distance 98 relative to the magnetic hub 80 with a center alignment mechanism 99 such as to contact the disc 90 with the first segment 102 and the disc centering support pads, the first contact 14 and the second contact 15, of the second segment 112 to center align the first coupling interface 86 with the second coupling interface 88. That is, the center alignment mechanism 99 includes a recessed opening 103 larger than the diameter of the disc 90. The rotational device 70 is configured to rotate the magnetic hub 80 to angle-align the first coupling interface 86 with the second coupling interface 88 to allow the disc 90 to mate to the magnetic hub 80 magnetically. In some examples, the hub 80 may be non-magnetic and have another type of attachment device as an alternative disc mounting assembly. The alternative disc mounting assembly should maintain enough resistance against rotation to facilitate the engagement of whatever coupling members are used. In this example, the satellite protrusion 84. The center alignment mechanism 99 may be biased to move the first contact 14 and the second contact 15 the mounting distance 98 away from the disc 90 once the disc 90 is mated to the hub 80.

To allow for the mounting distance 98 movements, the back plate 100, the back-plate shield 101 in this example, may have a shield opening 107 larger than the axle 106 to facilitate relative movement of the back plate 100 to the rotational device 70. The back plate 100 may also have a set of vacuum openings 116 to allow coupling to a vacuum source via one or more vacuum couplers 118. In some configurations or examples, one or more of the set of vacuum opening 116 may have a vacuum plug 119 to seal a respective vacuum opening 116. Accordingly, the back plate 100 may include a set of vacuum openings 116 and an opposing front cover 125 spanning a portion of the recessed opening 103. The opposing front cover 125 includes a first recessed channel 120 extending from the first contact 14 and the second contact 15 to the set of vacuum openings 116. When at least one of the set of vacuum openings 116 is coupled to a vacuum source, the first recessed channel 120 forms a vacuum cavity for collecting and removing material from the tool 10. Additionally, the back plate 100 may include a second recessed channel 122 extending around the recessed opening 103 and extending towards the first recessed channel 120 to extend the vacuum cavity.

To help in preventing the disc 90 from being separated from the hub 80 by the pressure of a tool or work article on the disc 90 during use, a ledge 105 is formed in the back plate 100 to prevent tipping of the disc 90. To facilitate removal of the disc 90, a demounting lever 28 may be configured to the back plate 100 to allow the disc 90 to be tipped away from the hub 80. Accordingly, one or more ledges 105 are within the recessed opening 103. The ledges 105 are configured to prevent the disc 90 from being tipped when a force is applied to a face of the disc 90 during operation and thereby preventing the first coupling interface 86 to unmate from the second coupling interface 88. The demounting lever 28 may be attached to the back plate 100 and biased in a first position that is not in contact with a backside of the disc 90 and movable to a second position to contact the backside of the disc 90 to tip the disc 90. This tipping allows the first coupling interface 86 to unmate from the second coupling interface 88 in the disc 90 and to allow further a user to grab the disc 90 for removal. The biasing of the demounting lever 28 may be spring biased, gravity biased, or other.

For additional safety when rotating the rotational device 70, a safety shield may be mounted between the counterweight 73 and spacer 3 to prevent an operator's fingers from being caught between the counterweight 73 and the adjustment mount block 9. The safety shield 71 may be constructed of a transparent, partially transparent, or opaque plastic, glass, ceramic, or metal material. A transparent or partially transparent (such as a screen material) may help to allow a user to view adjustment clamps 25 when moving the adjustment mount block 9 up and down.

Figure 3A:
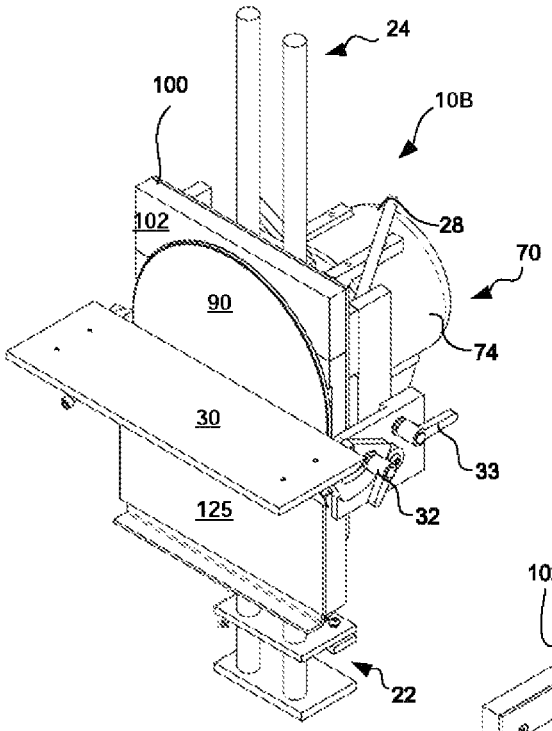
FIGS. 3A and 3B are front and rear perspective views, respectively, of an example grinder tool with a motor rotational device and a work shelf accessory.
Figure 3B:
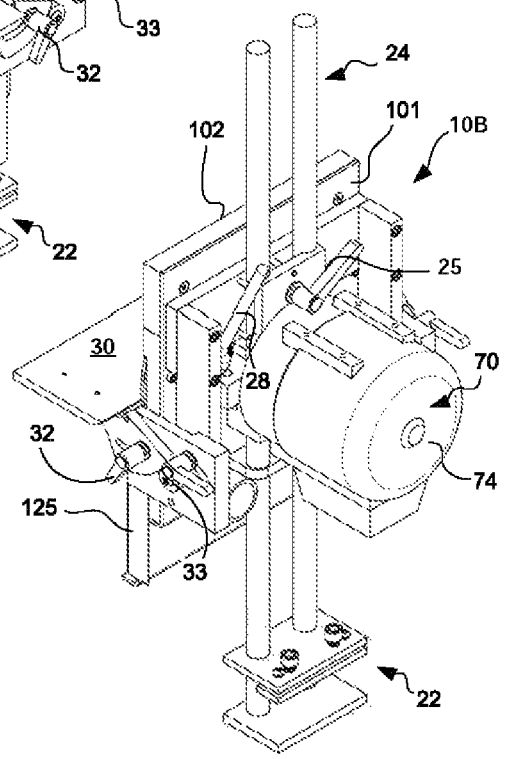
Figure 4:
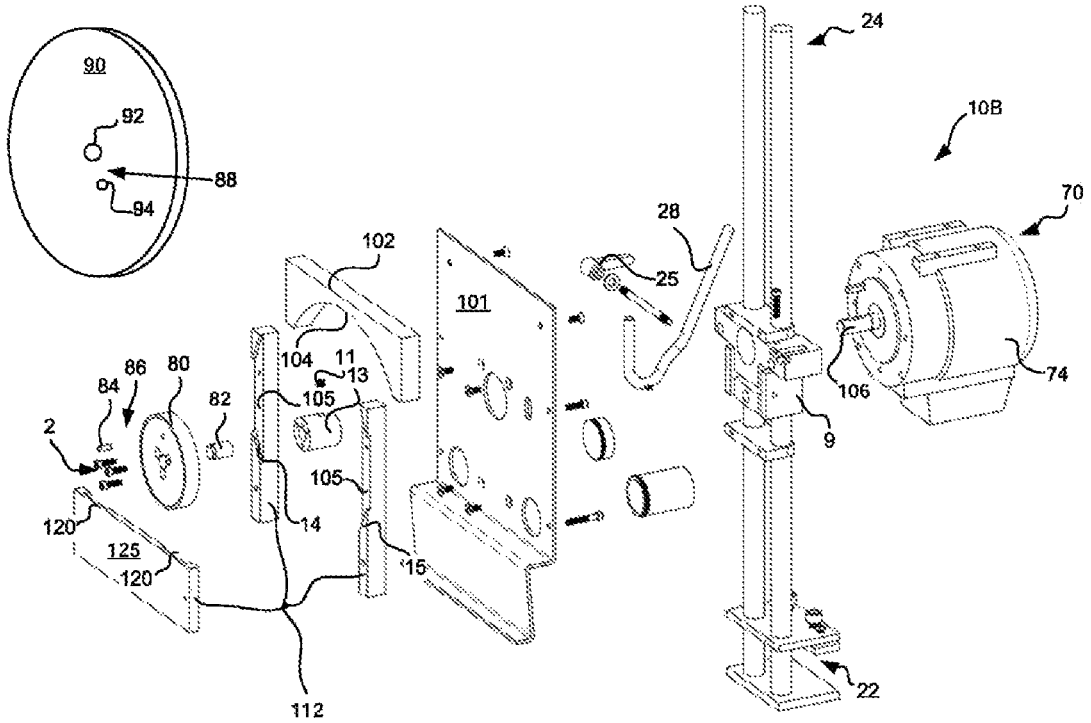
FIG. 4 is an exploded view of the example grinder tool shown in FIGS. 3A and 3B without the work shelf.
Figure 5A:
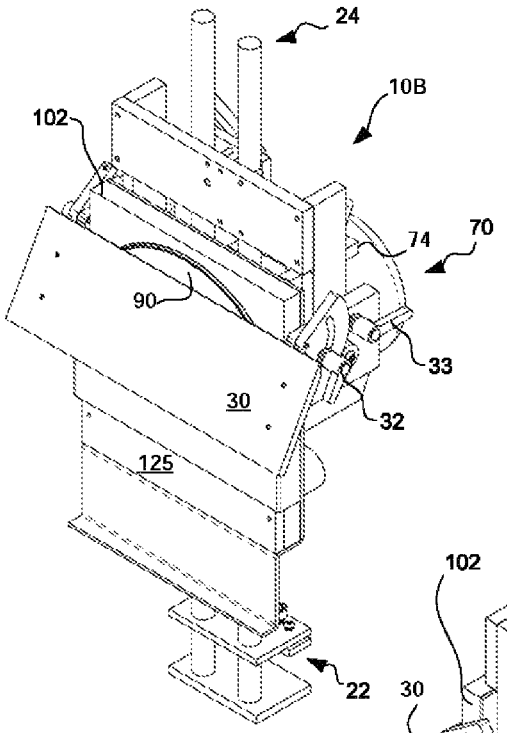
FIGS. 5A and 5B are front and rear perspective views, respectively, of the example grinder tool in FIGS. 3A and 3B with the work shelf in alternate positions.
Figure 5B:
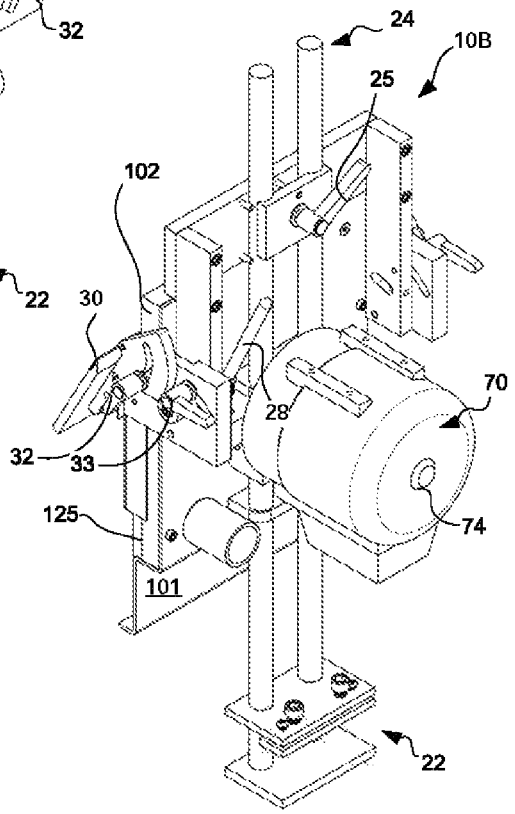

FIGS. 3A and 3B are front and rear perspective views, respectively, of an example motor grinder tool 10B with a motor rotational device 70 and a work shelf 30 accessory. The work shelf 30 may also be attached to the example manual grinder tool 10A of FIGS. 1A, 1B and 2. FIG. 4 is an exploded view of the example motor grinder tool 10B shown in FIGS. 3A and 3B without the work shelf 30. FIGS. 5A and 5B are front and rear perspective views, respectively, of the example motor grinder tool 10B in FIGS. 3A and 3B with the work shelf 30 in alternate positions.

In this example, guide rods 24 are attached to adjustment mount block 9 which is further supporting the mounting of a motor 74. Adjustment block 9 allows for vertical up-down positioning of the motor 74. An adjustment clamp 25 may be used to fix the height of the motor 74 to the guide rods 24. A second table mount 22 is used to attach the guide rods 24 to a workbench, work table, or another work area. The motor 74 has an axle 106 that when mounted to adjustment mount block 9 extends through an opening and may be extended by a coupler 13 and set screw 11 to a center protrusion 82. The center protrusion 82 extends through the hub 80 which is mounted to the coupler 13 with screws 2. A satellite protrusion 84 may be press-fitted to hub 80 to form a first coupling interface 86 with the center protrusion 82. Shown in FIG. 4 is the backside of the disc 90 with center opening 92 and satellite opening 94 forming the second coupling interface 88 for mating with the first coupling interface 86. Other coupling interfaces may be used.

The work shelf 30 may be attached to the back plate 100 and extends in an orthogonal direction to the back plate 100. The work shelf 30 may be adjustable at multiple angles from the normal in the orthogonal direction with a first shelf adjustment clamp 32. The work shelf 30 may also be adjustable toward and from the back plate 100 with a second shelf adjustment clamp 33. By having an adjustable work shelf 30, the approach of a workpiece to the grinding surface can be varied as required for any particular grinding task.

Figure 6A:
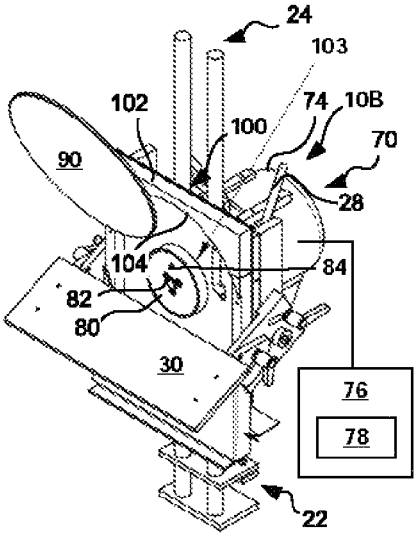
FIGS. 6A, 6B, 6C, and 6D are front perspective views of an example grinder tool illustrating the steps in mounting a disc to the grinder tool.
Figure 6B:
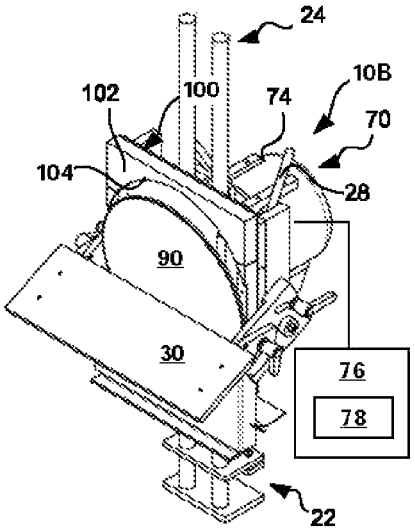
Figure 6C:
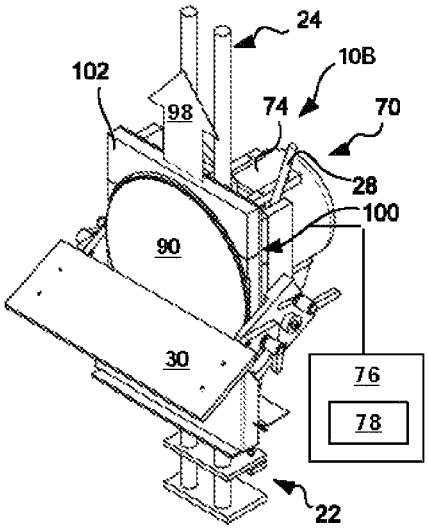
Figure 6D:
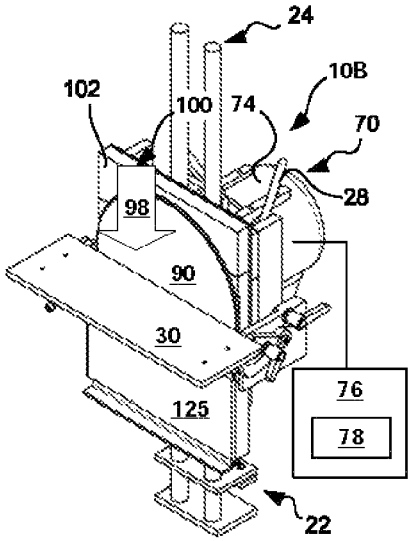

FIGS. 6A, 6B, 6C, and 6D are front perspective views of an example motor grinder tool 10B illustrating the steps in mounting a disc 90 to the motor grinder tool 10B. In FIG. 6A, the work shelf 30 is adjusted down and away from the back plate 100. The motor 74 is coupled to a motor controller 76 having a mounting mode routine 78. To blind load the disc 90 to the motor grinder tool 10B, the disc 90 with a first coupling interface 86 is inserted into a recessed opening 103 of the back plate 100 as shown in FIG. 6B. The back plate 100 is attached to a rotational device 70, motor 74 in this example, further coupled to a hub 80 having a second coupling interface 88. In FIG. 6C, the back plate 100 is moved a mounting distance 98 to contact the disc 90 at a first contact 14 and a second contact 15 (see FIG. 4) of the recessed opening 103 to center and vertically align the first coupling interface 86 to the second coupling interface 88. The rotational device 70, motor 74 in this example or rotational device 70 in the example of FIGS. 1A, 1B and 2, is slowly rotated to align the first coupling interface 86 further to the second coupling interface 88 to allow the disc 90 to attach firmly to the hub 80. In this example, this rotation allows the satellite opening 94 on the hub 80 to align with the satellite protrusion 84 on the backside of the disc 90. The slow rotation can be done by a user finesse with the hand crank or by the mounting mode routine 78 of motor controller 76. In the mounting mode, the motor controller 76 instructs the mounting mode routine 78 to rotate slowly (such as less than 50 RPM). This can be initiated by a user pressing a disc mount button (not shown) readable by the motor controller 76. If a magnetic hub 80 is used and the disc 90 is ferromagnetic, the disc 90 will "snap" flush or flatly to the magnetic hub 80. If an alternative disc attachment system is used, the hub 80 may not be required to rotate. Once mounted, the back plate 100 may be moved opposite the mounting distance 98 as shown in FIG. 6D. The work shelf 30 may be moved back to the desired working position as shown.

The disc centering support pads, first contact 14 and second contact 15, can also be fixed in position to center the disc 90 on the vertical axis of the center protrusion 82, and with the center opening 92 of the disc 90 a distance below the center protrusion 82 small enough to allow a user to grasp and raise the disc 90 to blindly engage the center protrusion 82 in the center opening 92 hole of disc 90.

To remove the sanding or grinding disc 90, a demounting lever 28 attached to the back plate 100 may be moved to a first position to allow the disc 90 to decouple from the hub 80. A user then may grab the disc and pull it away from the tool.

The motor controller 76 may include one or more processors having one or more cores and be made up of one or multiple processor architectures such as x86™, x64™, ARM™, PowerPC™, and the like. The processor(s) are coupled to computer readable medium (CRM) to read and execute instructions that implement the mounting mode routine. In other examples, the mounting mode routine may be partially or fully implemented using logic and digital and/or analog circuitry. The motor controller's 76 main memory and the processor memory may each constitute computer-readable medium. The term "computer-readable medium" may include single medium or multiple media (centralized or distributed) that store the instructions or data structures. CRM may be implemented to include, but not limited to, solid-state, optical, and magnetic media whether volatile or non-volatile. Such examples include, semiconductor memory devices (e.g. Erasable Programmable Read-Only Memory (EPROM), Electrically Erasable Programmable Read-Only Memory (EEPROM), and flash memory devices), magnetic discs such as internal hard drives and removable discs, magneto-optical discs, and CD-ROM (Compact Disc Read-Only Memory) and DVD (Digital Versatile Disc) discs.

Figure 7A:
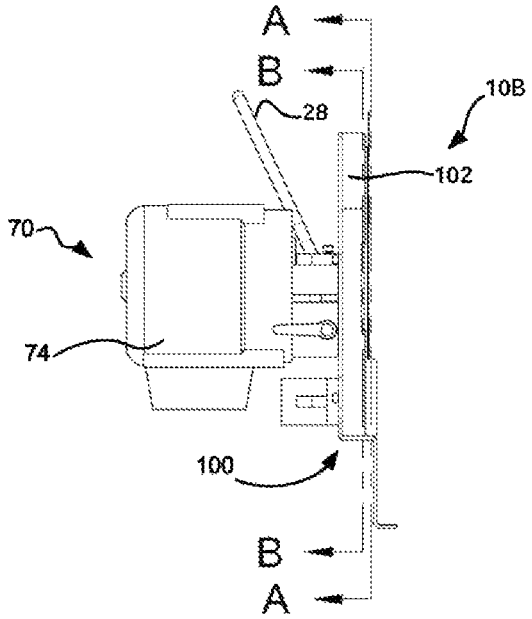
FIG. 7A is a side perspective view of an example grinder tool illustrating where cut views of FIGS. 7B and 7C occur.
Figure 7B:
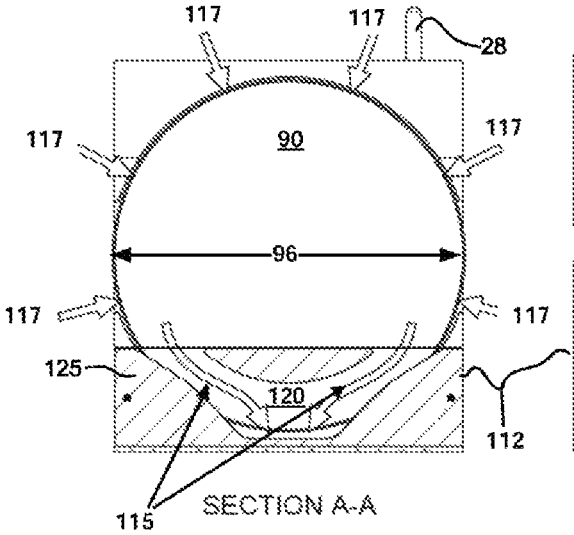
FIGS. 7B and 7C are cut views of the example grinder tool shown in FIG. 7A to illustrate vacuum channels.
Figure 7C:
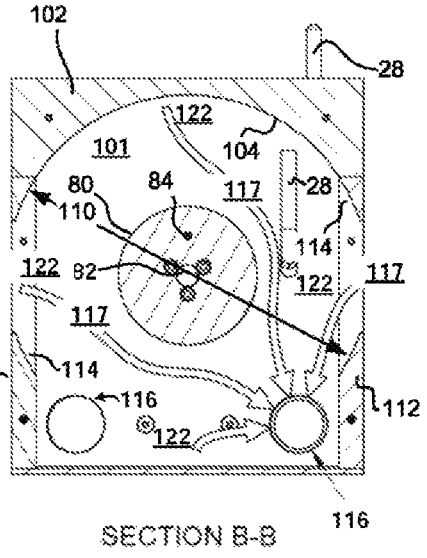

FIG. 7A is a side perspective view of an example motor grinder tool 10B illustrating where cut views of FIGS. 7B and 7C occur. FIGS. 7B and 7C are cut views of the example motor grinder tool 10B shown in FIG. 7A to illustrate vacuum channels in one example. FIG. 7B shows the cut through section A-A of FIG. 7A. FIG. 7C shows the cut through section B-B of FIG. 7A.

In FIG. 7B, the front cover 125 is shown as transparent and has a first recessed channel 120 to allow first vacuum airflow 115 to extend from the front surface of the disc 90 to under the disc 90 to a second recessed channel 122 (FIG. 7C) behind the mounted disc 90 on back plate 100. In FIG. 7C, beneath the disc 90, the waste particles and air are transported by the second vacuum flow 117 to at least one of the set of vacuum openings 116.

In addition, a second vacuum airflow 117 draws material from the front surface of disc 90 to the back surface and second recessed channel 122. The second vacuum airflow 117 is drawn into any of the set of vacuum openings 116 that are coupled to a vacuum source. The second recessed channel 112 is defined by the shape of the first segment 102 and second segment 112 of the back plate 100. The distance between the disc 90 and edges of the first segment 102 form a first segment opening 104. Likewise, the distance between the disc 90 and the edges of the second segment 112 form a second segment opening 114 leading to the second recessed channel 122.

Figure 8A:
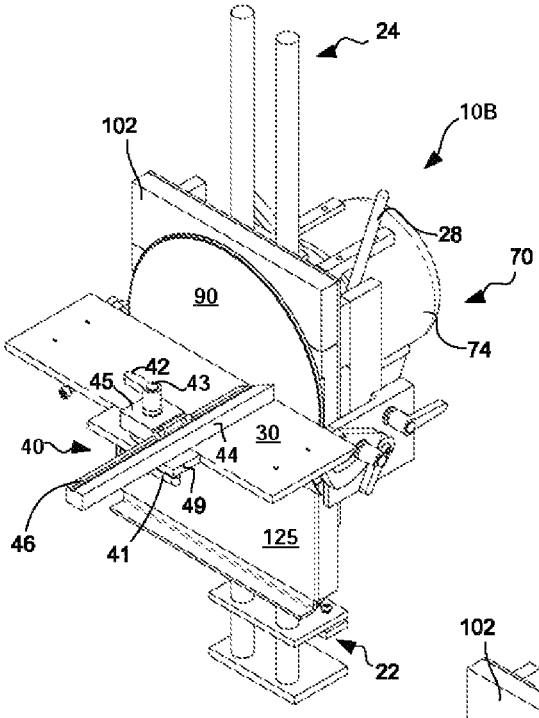
FIGS. 8A and 8B are front perspective views of a grinder tool with an example adjustable fence accessory in different positions.
Figure 8B:
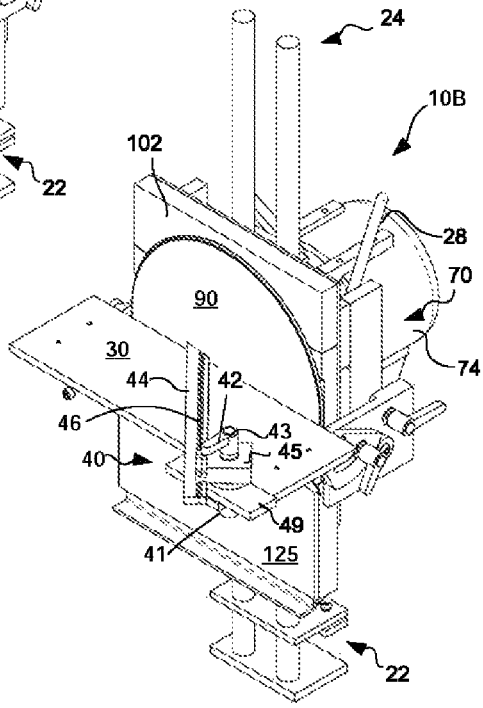
Figure 9:
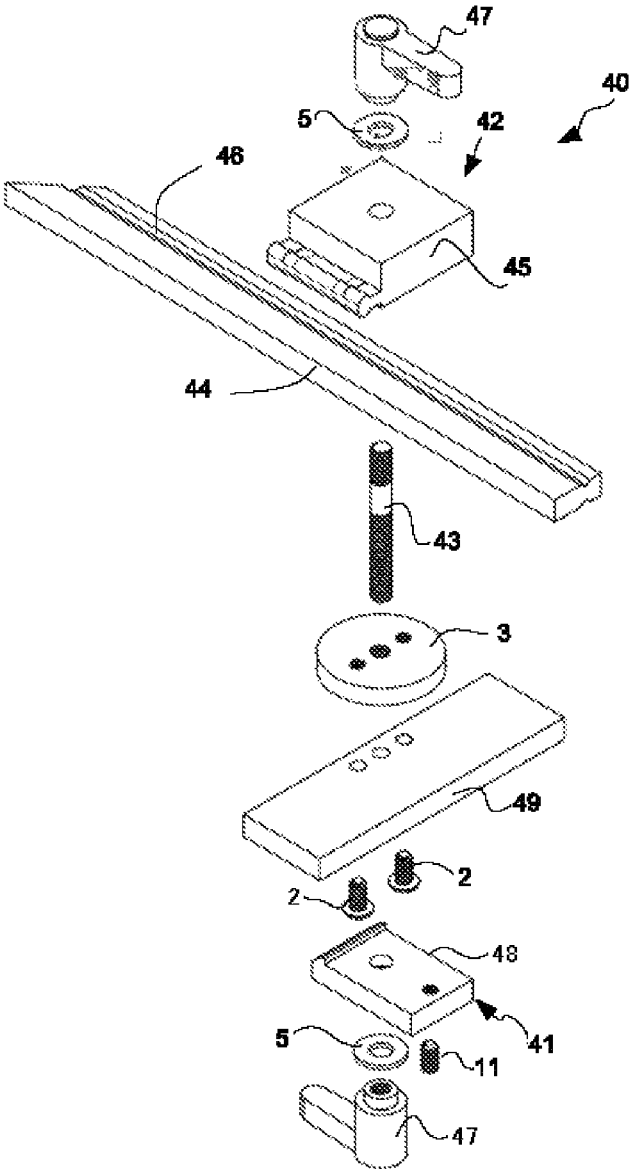
FIG. 9 is an exploded view of the example adjustable fence shown in FIGS. 8A and 8B.

FIGS. 8A and 8B are front perspective views of a motor grinder tool 10B with an example adjustable fence 40 accessory in different positions. FIG. 9 is an exploded view of the example adjustable fence 40 shown in FIGS. 8A and 8B. In one example, the adjustable fence 40 is couplable to the work shelf 30 with a first fence clamp 41 with a bottom knob 47, shelf clamp 48, and shelf edge aligner 49. The first fence clamp 41 has a screw mount 43 extending in a direction normal to the top surface of the work shelf 30. A second fence clamp 42 has first and second opposing surfaces on a channel guide 45, the surfaces extending normal from the screw mount and the first and second opposing surfaces each have a channel guide 45 of different heights to accommodate different thicknesses of an elongated portion 44. The adjustable fence 40 has at least one elongated portion 44 with a thickness and a fence channel 46 to couple to a respective channel guide 45. The second fence clamp 42 is adjustable about a rotational axis around the screw mount 43. The elongated portion 44 is also adjustable in a linear direction back and forth along the channel. The screw mount 43 accepts a tightening screw top knob 47 to clamp the elongated portion 44 once positioned.

Accordingly, a first fence clamp 41 to fasten the adjustable fence 40 the work shelf 30. A screw mount 43 extends in a direction normal to the top surface of the work shelf 30. A second fence clamp 42 has a channel guide 45 and first and second opposing surfaces extend normal from the screw mount 43. The first opposing surface has a first height from the center of the channel guide 45 and the second opposing surface has a different second height from the center of the channel guide 45. A first elongated portion 44 has a thickness about the height of the first height. In some examples, a second elongated portion 44 has a thickness about the height of the second height and may be swapped with the first elongated portion 44. The first and second elongated portions 44 have a fence channel 46 to couple to a respective side of the channel guide 45. The second fence clamp 42 is adjustable in a rotational axis around the screw mount 43. The first and second elongated portions 44 may be adjusted in a linear direction back and forth along the fence channel 46. The screw mount 43 accepts a tightening screw knob 47 to clamp the first or second elongated portion 44 once positioned on the work shelf 30.

Figure 10:
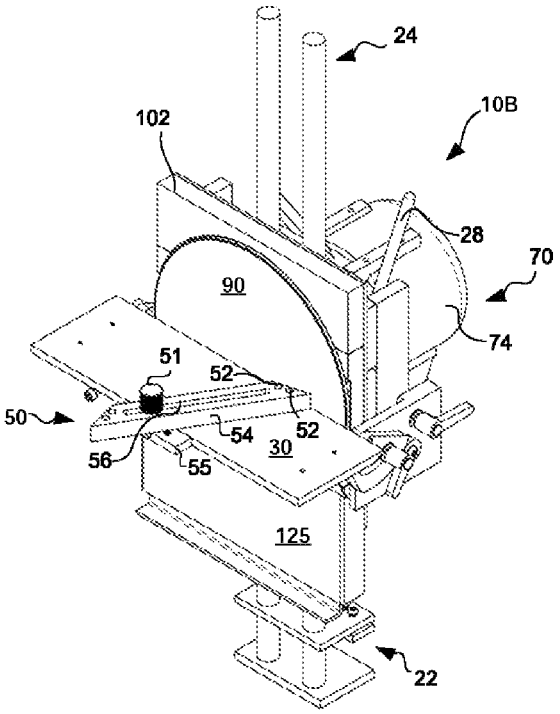
FIG. 10 is a front perspective view of a grinder tool with an example magnetic fence accessory.
Figure 11A:
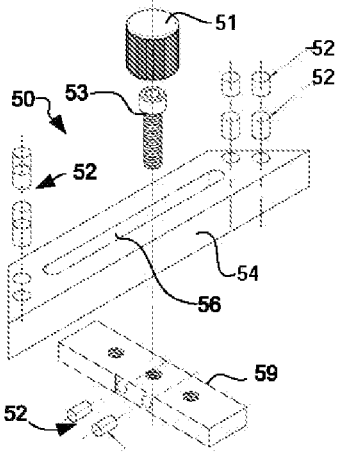
FIGS. 11A and 11B are an exploded view and an assembled view, respectively, of the example magnetic fence shown in FIG. 10.
Figure 11B:
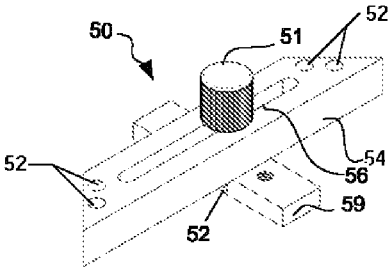

FIG. 10 is a front perspective view of a motor grinder tool 10B with an example magnetic fence 50 accessory. FIGS. 11A and 11B are an exploded view and an assembled view, respectively, of the example magnetic fence 50 shown in FIG. 10. To help in positioning a workpiece on the work shelf 30, in one example, the work shelf 30 is coupled to a magnetic fence 50. The magnetic fence 50 has a first clamp having a screw mount 53 extending in a direction normal to the top surface of the work shelf 30 and a first portion of the magnetic fence 50, a magnetic shelf edge aligner 59, is magnetically coupled to a side edge of the work shelf 30. The magnetic fence 50 has a second portion, magnetic elongated portion 54, with an elongated opening 56 encircling the screw mount 53 and adjustable in a rotational axis around the screw mount 53. The magnetic elongated portion 54 of the magnetic fence 50 is also adjustable in a linear direction back and forth along the elongated opening 56. The magnetic elongated portion 54 of the magnetic fence 50 is magnetically coupled to the top side of the work shelf with magnets 52. The screw mount 53 accepts a tightening screw knob 51 to clamp the magnetic elongated portion 54 once positioned.

Accordingly, a first portion, the magnetic shelf edge aligner 59, has a screw mount 53 that extends in a direction normal to a top surface the first portion. The first portion is configured to magnetically couple to a side edge of the work shelf 30. A second portion, the magnetic elongated portion 54, has an elongated opening 56 to encircle the screw mount 53 and may be adjusted about a rotational axis around the screw mount 53. The second portion may also adjust in a linear direction back and forth along the elongated opening 56. The second portion is configured to magnetically couple to a top side of the work shelf 30. A tightening screw knob 51 on the screw mount 53 is configured to clamp the second portion once positioned.

Figure 12A:
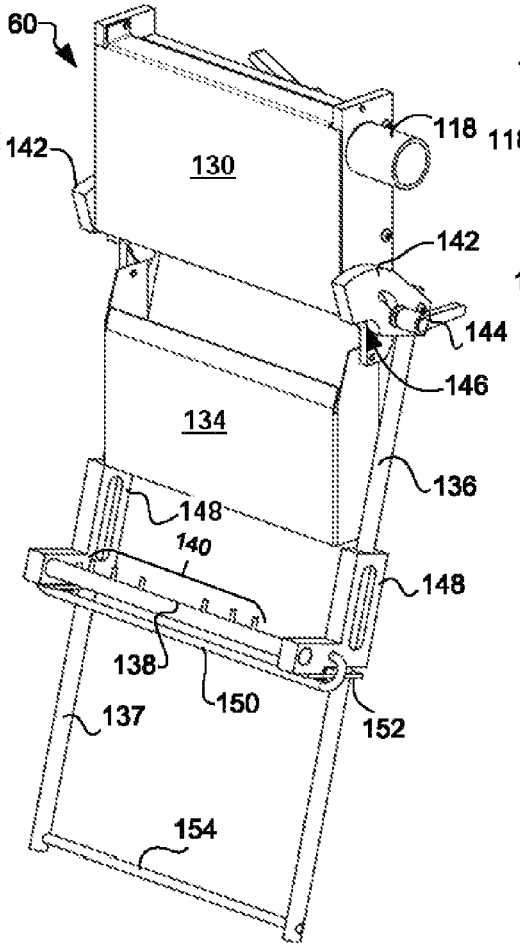
FIGS. 12A and 12B are front and rear perspective views, respectively, of an example tool sharpening accessory for a grinder tool.
Figure 12B:
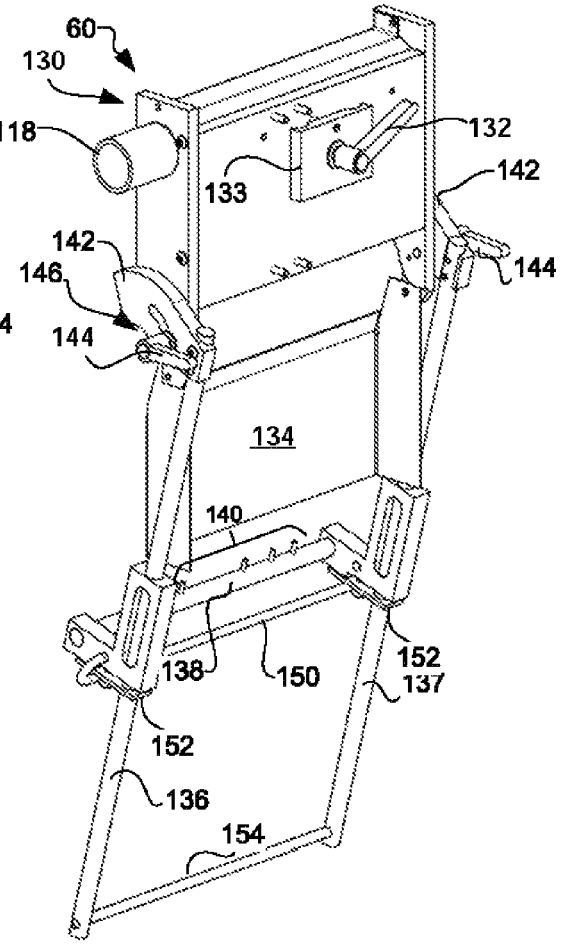
Figure 13:
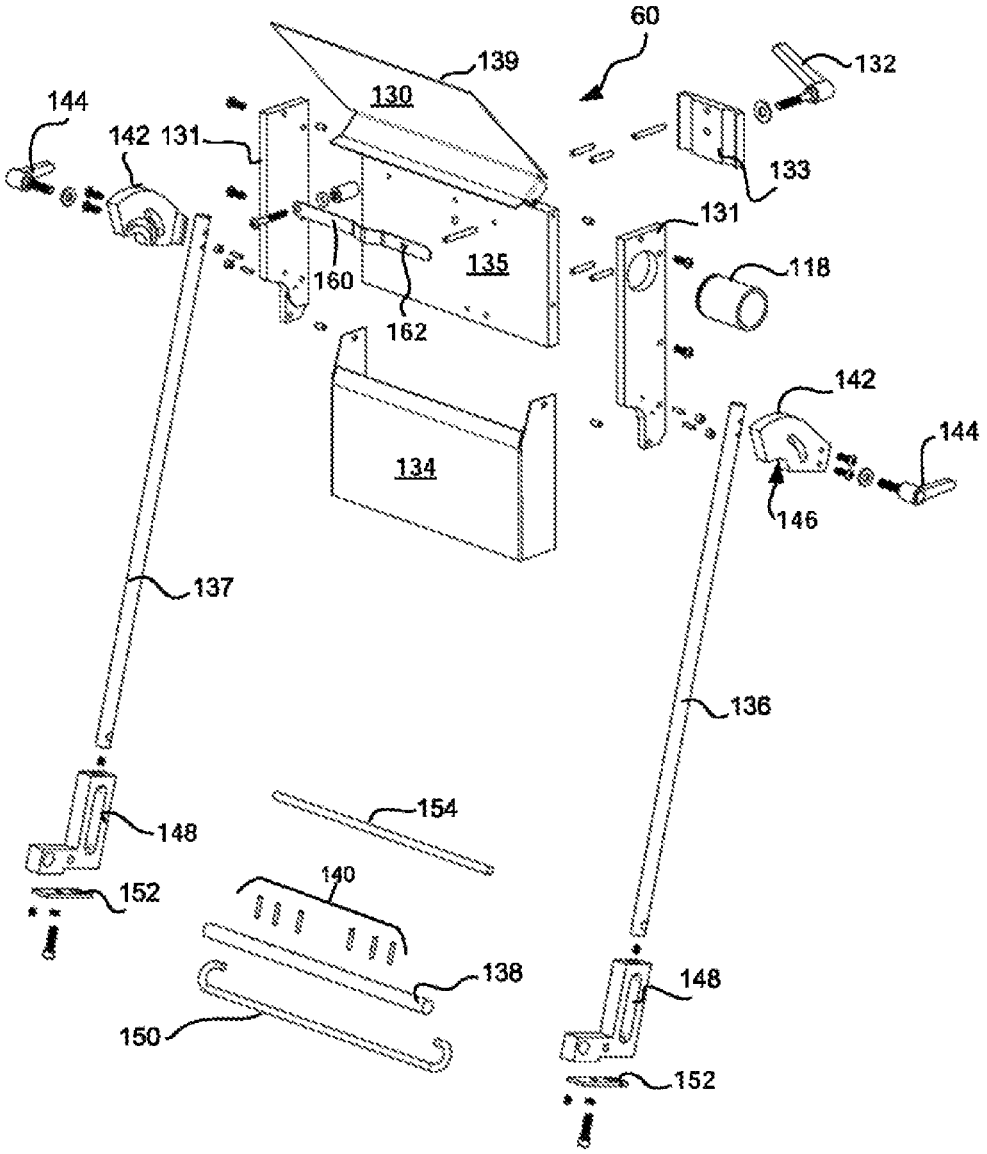
FIG. 13 is an exploded view of the example tool sharpening accessory of FIGS. 12A and 12B.
Figure 14A:
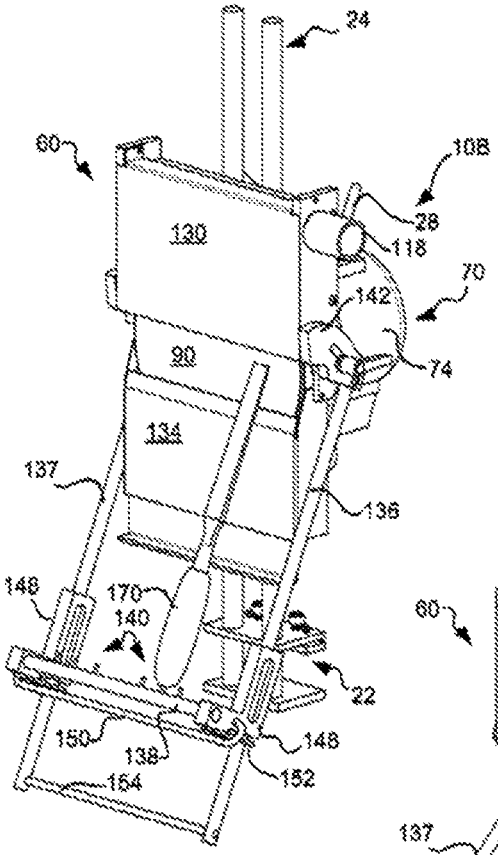
FIGS. 14A and 14B are front perspective views the example tool sharpening accessory mounted to the grinder tool illustrating different positions and placement of a tool to be sharpened.
Figure 14B:
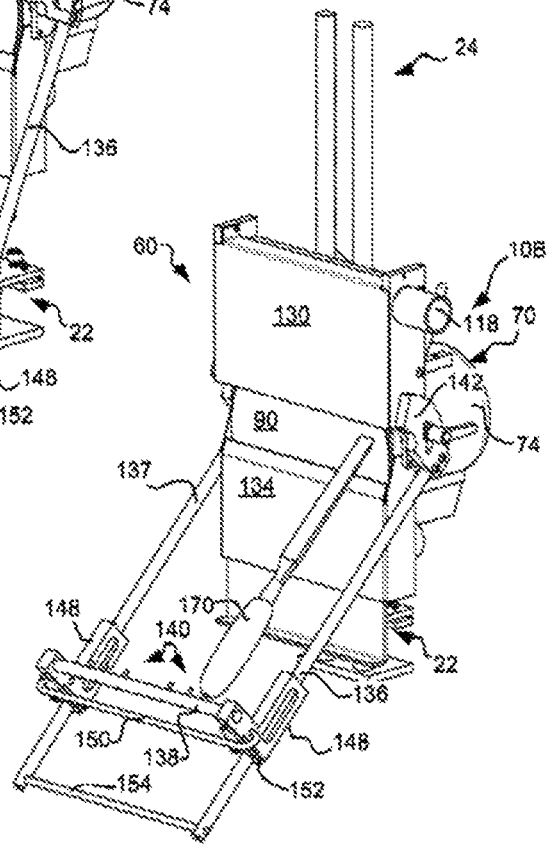
Figure 14C:
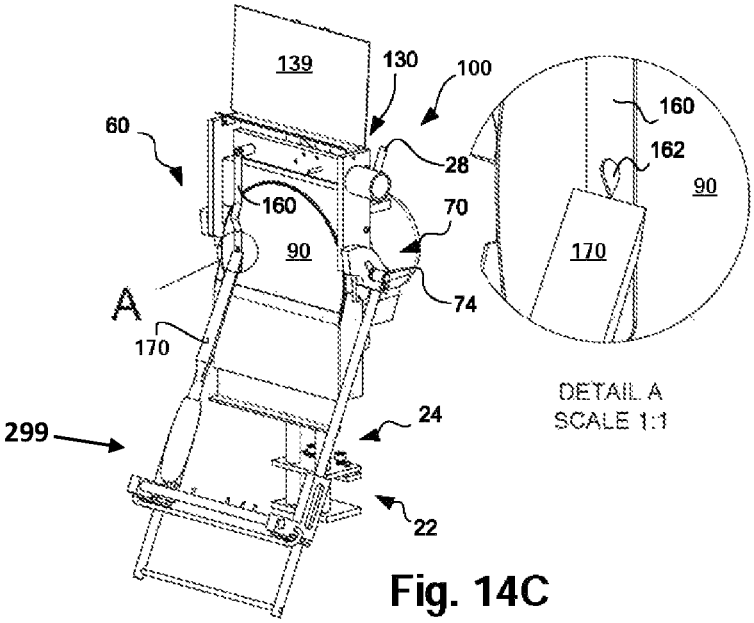
FIGS. 14C and 14D are front and side perspective views, respectively, of the example tool sharpening accessory showing example adjustments of the example tool sharpening accessory.
Figure 14D:
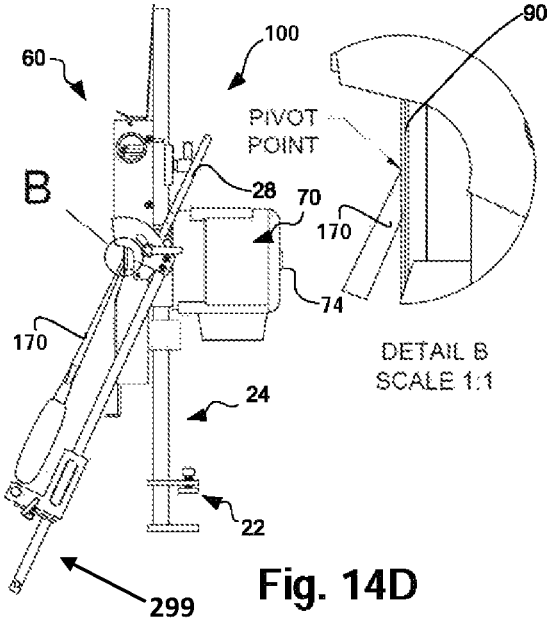
Figure 14E:
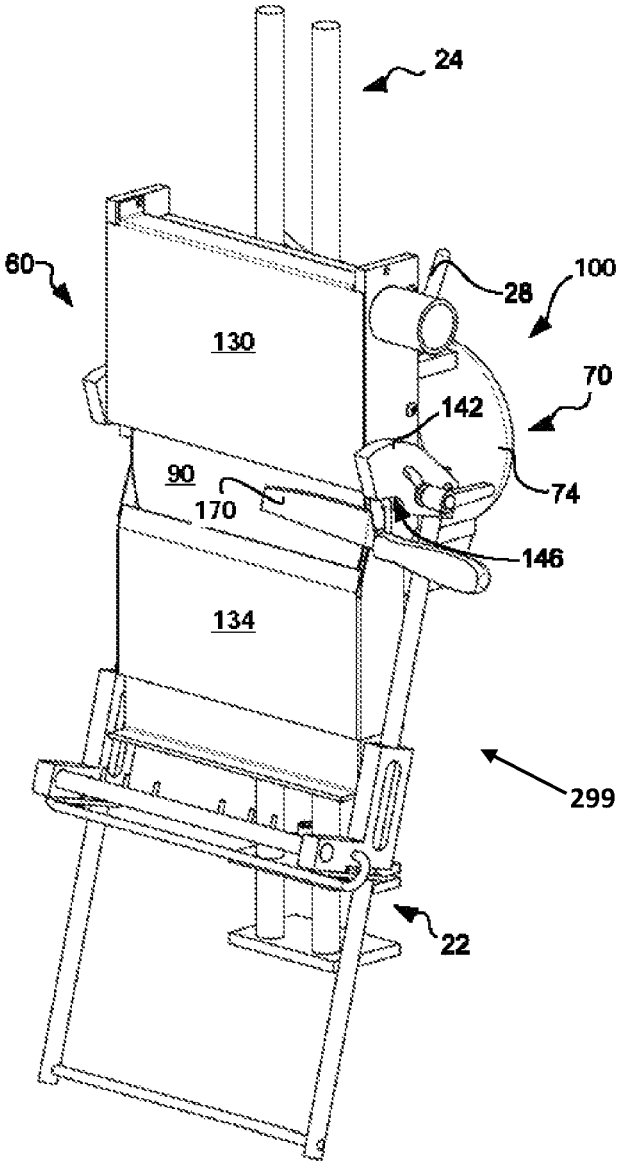
FIG. 14E is a front perspective view of the example tool sharpening accessory and positioning of a tool to be sharpened from the side of the example tool sharpening accessory.

FIGS. 12A and 12B are front and rear perspective views, respectively, of an example tool sharpening accessory 60 for a manual grinder tool 10A or a motor grinder tool 10B. FIG. 13 is an exploded view of the example tool sharpening accessory 60 of FIGS. 12A and 12B. FIGS. 14A and 14B are front perspective views of the example tool sharpening accessory 60 mounted to the motor grinder tool 10B illustrating different positions and placement of a tool 170 to be sharpened. FIGS. 14C and 14D are front and side perspective views, respectively, of the example tool sharpening accessory 60 showing additional example adjustments of the example tool sharpening accessory 60. Finally, FIG. 14E is a front perspective view of the example tool sharpening accessory 60 and positioning of a tool 170 to be sharpened from the side of the example tool sharpening accessory 60. The tool sharpening accessory 60 may be used to improve productivity and efficiency when using a grinder tool to sharpen a work working or another hand tool 170. The tool sharpening accessory 60 allows for multiple positioning of a tool surface to the disc surface to ensure fast and effective sharpening and ability to sharpen various wood cutting, curved, flat-bladed, or other tool surfaces.

The tool sharpening accessory 60 may be attached to the guide rods 24 of table mount 22 of the manual grinder tool 10A or the motor grinder tool 10B. The tool sharpening accessory 60 includes a first arm 136 extending in a first direction and a second arm 137 extending parallel in the first direction. The first and second arms 136, 137 are disposed on opposing sides of the disc 90. A tool holding rod 138 extends between the first arm 136 and the second arm 137. The tool holding arm 138 has one or more sets of pins 140 located at predetermined positions. The pins 140 may be arranged to allow for left and right-hand operation during sharpening of a tool 170. The set of pins 140 allow for interfacing with a tool 170 to be sharpened as shown in FIGS. 14A-E. The tool holding rod 138 is adjustable along the first direction. The tool sharpening accessory 60 includes a pair of mounting brackets 142 each attached to the first arm 136 and the second arm 137 separately. The mounting brackets 142 allow the tool sharpening accessory 60 to be rotatable around an axis where the tool sharpening accessory 60 is mounted to the guide rods 24 with mount plate 143 and mounting clamp 132 to adjust the pivot point of the tool 170 to the disc 90 surface (FIG. 14D). The mounting brackets 142 are formed with a shaped opening 146 to allow the tool 170 to be sharpened to approach the disc 90 in a direction along the plane of the disc 90 from a side of the motor grinder tool 10B as shown in FIG. 14E, such as with a long-bladed knife. The tool sharpening accessory 60 may include a support rod 154 orthogonal to and at the distal end of the first and second arms 136, 137 for structural support. The support rod 154 may be used to connect the first arm 136 to the second arm 137 to provide stiffness in the movement of the first and second arms 136, 137.

The tool sharpening accessory 60 may also include a top vacuum collector 130 formed by a movable cover 139 and side enclosures 131. One or more of the side enclosures 131 may include a vacuum coupler 118 for attachment to a vacuum source. The tool sharpening accessory 60 may also include a bottom shield 134 to prevent inadvertent contact with the disc 90 during sharpening operations. The tool holding rod 138 may be moved up and down the first and second arms 136, 137 by pressing on a binding plate release bar 150 that releases a set of binding plates 152 that prevent the tool holding rod 138 movement. The tool holding rod 138 may also be rotated to and from the disc 90 to change the angle of sharpening by adjusting the mounting brackets 142 with adjustment knob 144. To aid in placing the tool at the correct location on the disc 90 during the adjustment of the tool holding rod 138, a position indicator 160 may be moved in front of the disc 90 and the surface of the tool 170 to be sharpened placed at the location of the alignment aid 162, shown here as a teardrop opening within the position indicator 160 and that locates the tool cutting edge at the axis of sharpening angle rotation.

Accordingly, a tool sharpening accessory 60 for a grinder tool 10A, 10B includes a first arm 136 extending in a first direction and a second arm 137 extending parallel in the first direction and the first and second arms 136, 137 opposite opposing sides of the grinder tool 10A, 10B. A tool holding rod 138 extends between the first arm 136 and the second arm 137. The tool holding rod 138 includes a set of pins 140 located at predetermined positions for interfacing to a tool 170 to be sharpened. The tool holding rod 138 is configured to be adjustable in the first direction.

The tool sharpening accessory 60 may also include a pair of mounting brackets 142 each attached to the first arm 136 and the second arm 137 separately. The mounting brackets 142 allow the tool sharpening accessory 60 to be rotatable around a tool sharpening angle axis when the tool sharpening accessory 60 is mounted to the grinder tool 10A, 10B. The mounting brackets 142 may be formed with a shaped opening 146 to allow the tool 170 to approach the disc 90 in a direction along the plane of the disc 90 from a side of the grinder tool 10A, 10B. In some examples, the tool holding rod 138 includes two binding plates 152 each having an opening encircling a respective first arm 136 and second arm 137. When the two binding plates 152 are in a first position, they are biased to contact the first and second arms to prevent descending linear adjustment of the tool holding rod 138. When the two binding plates 152 are in a second position, the two binding plates 152 are positioned to allow the tool holding rod 138 to be linearly adjusted in ascension or descension along the first direction. In one example, the tool holding rod 138 includes a binding plate release bar 150 parallel to the tool holding rod 138 and connected to the two binding plates 152. In another example not shown, the two binding plates 152 are separately biased with a spring, and each has a lever to allow de-biasing of the spring thereby requiring two-handed operation. To ease proper positioning of a tool 170, the tool sharpening accessory 60 may include an alignment aid 160 having an indicator 162 to align an end of the tool 170 on a disc 90 when the tool holding rod 138 is adjusted. Finally, the tool sharpening accessory 60 may also include a vacuum collector 130 between the first arm 136 and the second arm 137 to collect waste material and grinder surface grit.

Figure 15A:
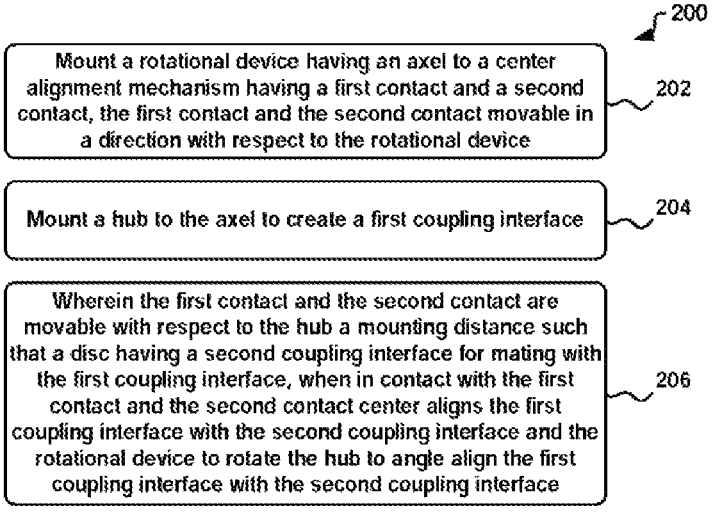
FIG. 15A is an example set of operations for a method of making a grinder tool.
Figure 15B:
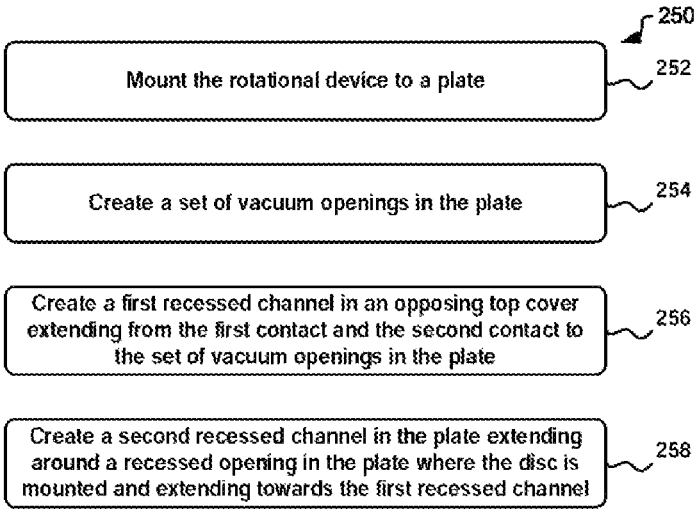
FIG. 15B are example additional operations that can be included in the example method of FIG. 15A.

FIG. 15A is an example set of operations 200 for a method of making a grinder tool 10A, 10B. FIG. 15B are example additional operations 250 that can be included in the example method of FIG. 15A. In block 202 a rotational device 70 having an axle 106 is mounted to a center alignment mechanism 99 that has a first contact 14 and a second contact 15 that are movable in a direction with respect to the rotational device 70. In block 204, a hub 80 is mounted to the axle 106 to create a first coupling interface 86. In block 206, the first contact 14 and the second contact 15 are configured to be movable with respect to the hub 80 a mounting distance 98 such that a disc 90 having a second coupling interface 88 for mating with the first coupling interface 86, when in contact with first contact 14 and the second contact 15 center aligns the first coupling interface 86 with the second coupling interface 88. The rotational device 70 is configured to rotate the hub 80 to angle-align the first coupling interface with the second coupling interface.

Additional operations 250 may be included in the method of making a grinder tool 10A, 10B. In block 252, the rotational device 70 may be mounted to a back plate 100. In block 254, a set of vacuum openings 116 may be made in the back plate 100. In block 256, a first recessed channel 120 may be created in an opposing top cover 125 extending from the first contact 14 and the second contact 15 to the set of vacuum openings 116 in the back plate 100. In block 258, a second recessed channel 122 may be created in the back plate 100 where the disc is mounted and the second recessed channel 122 extends toward the first recessed channel 120.

Figure 16A:
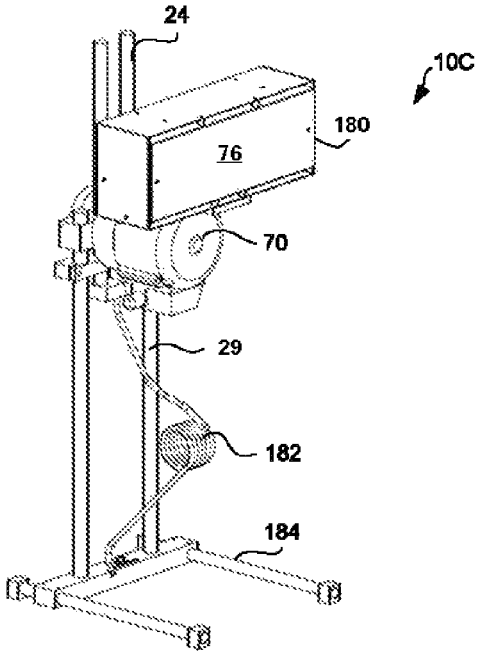
FIGS. 16A and 16B are two rear perspective views, respectively, of another example grinder tool with a control box, motor rotational device and a counterbalance in an upper and lower position, respectively.
Figure 16B:
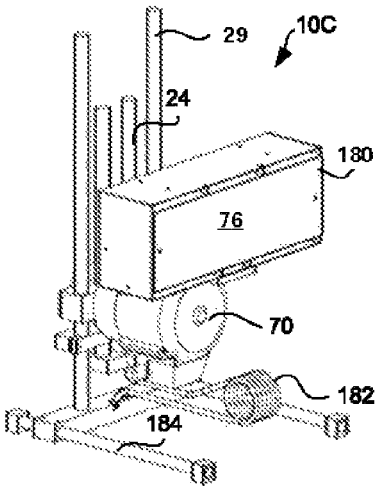

FIGS. 16A and 16B are two rear perspective views, respectively, of another example grinder tool 10C with a control box 180, motor rotational device 70 and a counterbalance 182 in an upper (FIG. 16A) and lower (FIG. 16B) position. In this example, the grinder tool 10C has a table base 184 that distributes the weight of grinder tool 10C from mount rods 29 across a larger area than the first table mount 20 of FIGS. 1A and 1B and the second table mount 22 of FIGS. 3A and 3B. This table base 184 provides good stability and the ability to move the grinder tool 10C on the table. The various table mounts and table base may be interchanged on the grinder tool 10B and 10C examples.

The control box 180 includes the motor controller 76 and mounting mode routine 78 along with other motor controller firmware. In this example, the control box 180 is positioned above motor rotational device 70 but in other examples, the control box 180 may be positioned in different locations and may also be positioned away from the grinder tool 10C but connected with an electrical cable. The motor rotational device 70 and the control box 180 may weigh a considerable amount in some examples, and manual adjustment may be assisted by the counterbalance 182, shown in this example as a coiled spring. In other examples, the counterbalance 182 may be a pneumatic lift assist, a vertical coiled spring, a magnetic lift assist device, a spring and pulley system, or other lift assist device. The purpose of the counterbalance 182 to help offset the weight of the movable members on the guide rods 24 so that during adjustment safety is enhanced.

Figure 17A:
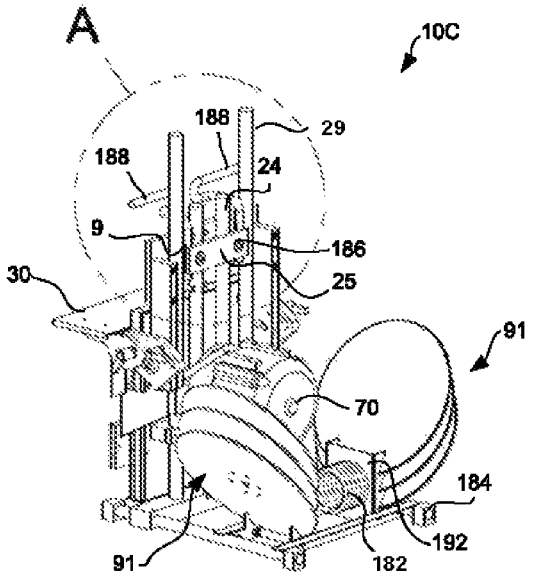
FIGS. 17A and 17B are an example illustration and detail of the example grinder tool of FIGS. 16A and 16B showing two-handed release levers and a spare disc holder.
Figure 17B:
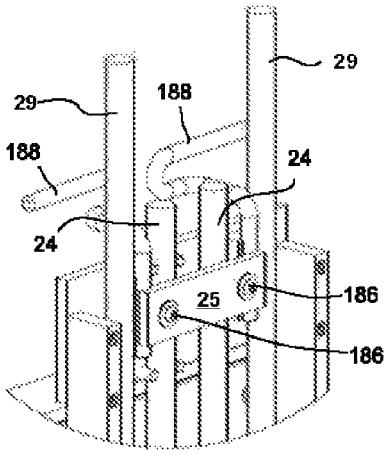

FIGS. 17A and 17B are an example illustration (FIG. 17A) and detail (FIG. 17B) of the example grinder tool 10C of FIGS. 16A and 16B showing two-handed release levers 188 and a spare disc holder 190. The control box 180 has been removed to show another example adjustment clamp 25, and a work shelf 30 is attached to the tool for illustration.

In this example, a couple of screws with spring washers 186 are used to provide the clamping force of the adjustment clamp 25 to the guide rods 24. An operator uses both hands, one on each release lever 188 to move the mounting block 9 of adjustment clamp 25 away from guide rods 24 to allow movement of the assembly. When the release levers are let go by the operator, the spring washers apply pressure of the mounting block 9 to the guide rods 24 to prevent movement. The disc holder 190 may be mounted to the table base 184 and used to store alternate discs 91, which may be of different grits or types of abrasive surfaces.

Figure 18A:
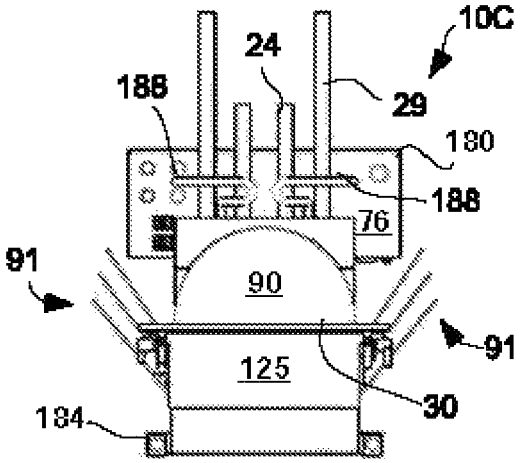
FIGS. 18A-18D are different views of the grinder tool of FIG. 17A in the lower position with a work shelf, spare disc holder, and control box.
Figure 18B:
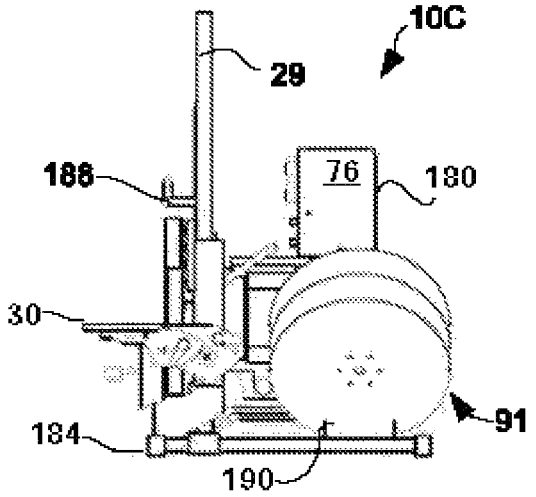
Figure 18C:
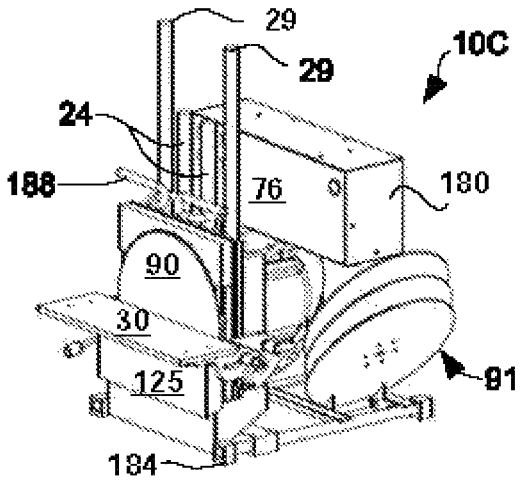
Figure 18D:
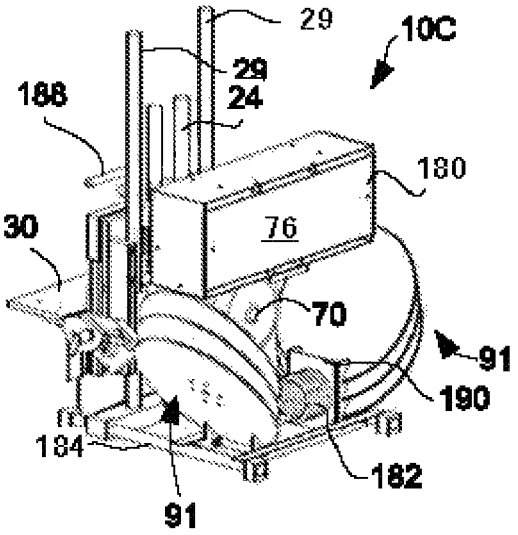

FIGS. 18A-18D are different views of the grinder tool 10C of FIG. 17A in the lower position with a work shelf 30, a spare disc holder 190 and alternate discs 91, and control box 180. The control box 180 contains the motor controller 76 and may include one or more knobs, buttons, switches, lights, displays, etc. used to set operational parameters and monitor the operation of the motor controller 76. FIG. 18A is a front view showing the disc 90, front cover 125, table base 184, work shelf 30, release levers 188, guide rods 24, and mount rods 29. FIG. 18B is a right-side view and FIG. 18C is a front-right perspective view and FIG. 18D is a back-right perspective view all showing the components of FIG. 18A from different angles.

Figure 19A:
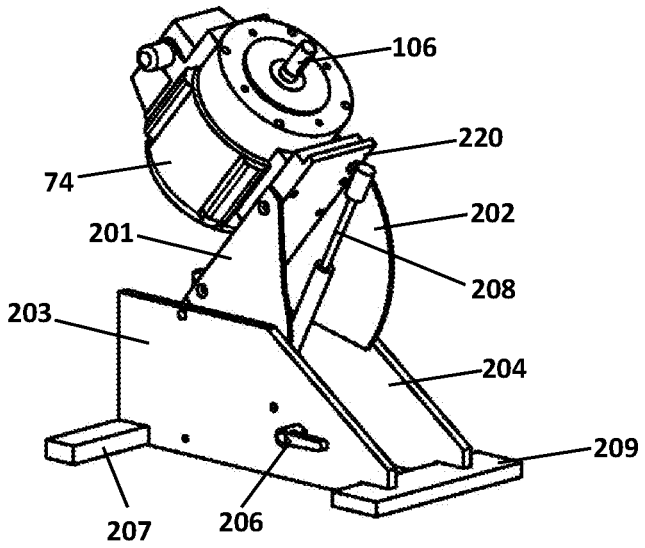
FIG. 19A is right perspective view of a motor on an alternate hinging base in a raised position.
Figure 19B:
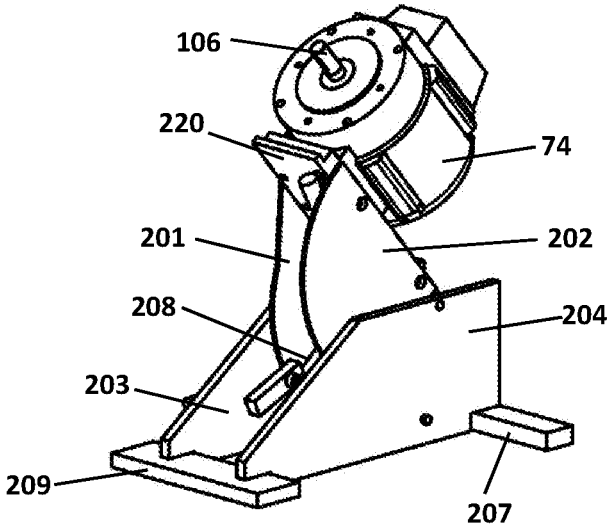
FIG. 19B is left perspective view of a motor on an alternate hinging base in a raised position.

FIGS. 19A and 19B are left and right perspective views of a motor 74 on a hinged downward motion-damping motor base 220. The hinged downward motion-damping motor base 220 is attached to a left guard 201 and a right guard 202. The guards 201, 202 are rotationally attached to a left base member 203 and a right base member 204 near the rear of each guard 201, 202 so that the hinged downward motion-damping motor base 220 and supports 201, 202 can pivot upwards or downwards around a central rotational point when a user causes the motor base 220 to raise or lower. Some embodiments are provided with a release lever 206 that frees the motor base 220 so that the motor base 220 is free to rotate up or down. When the grinder is at the desired angle, the user re-engages the lever 206 to lock the guards 201, 202 in place. This means that the grinder can be used in any position throughout the angular range of motion, not just at the top or bottom of the rotational arc.

The left and right base members 203, 204 provide a stable support platform when a user uses the invention, regardless of whether the hinged downward motion-damping motor base 220 is in a raised or lowered position. The base members 203, 204 are attached to a front and rear mounting plates 209, 207, respectively, that serve to secure embodiments of the invention to a worktable or the like. The mounting plates 209, 206 provide support surfaces so that the invention is less prone to sliding, tipping, or unwanted motion during use. The mounting plates 209, 207 allow the embodiments of the invention to sit freely on a worktable, or, alternatively, holes or other attachments are provided so that the mounts can be bolted or otherwise attached to the worktable.

A damper 208 is provided that provides resistance when the hinged downward motion-damping motor base 220 is lowered. The damper 208 smoothes the rotational motion of the base 220 and prevents rapid changes in position, falling of the base 220, damage to the grinder, or injury to a user that may occur through uncontrolled descent of the grinder. That is, when the release lever 206 is disengaged and the base 220 allowed to move, the damper 208 resists translation of the base 220 from a first position to a second position.

Figure 20A:
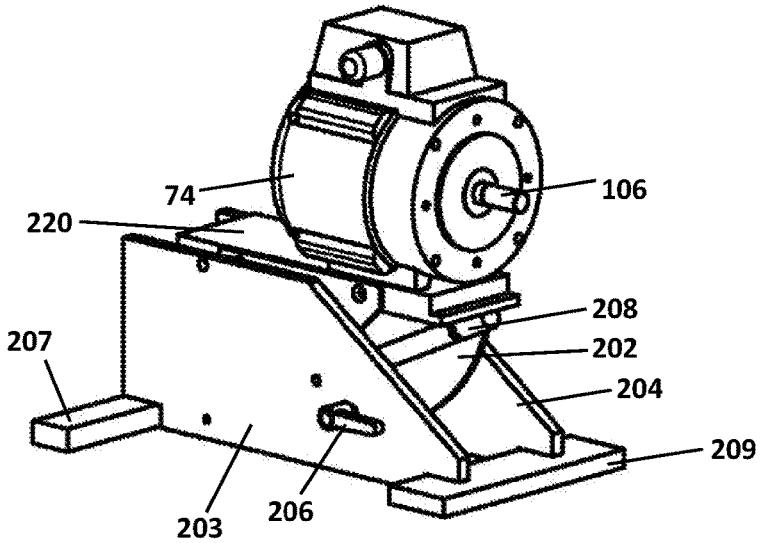
FIG. 20A is right perspective view of a motor on an alternate hinging base in a lowered position.
Figure 20B:
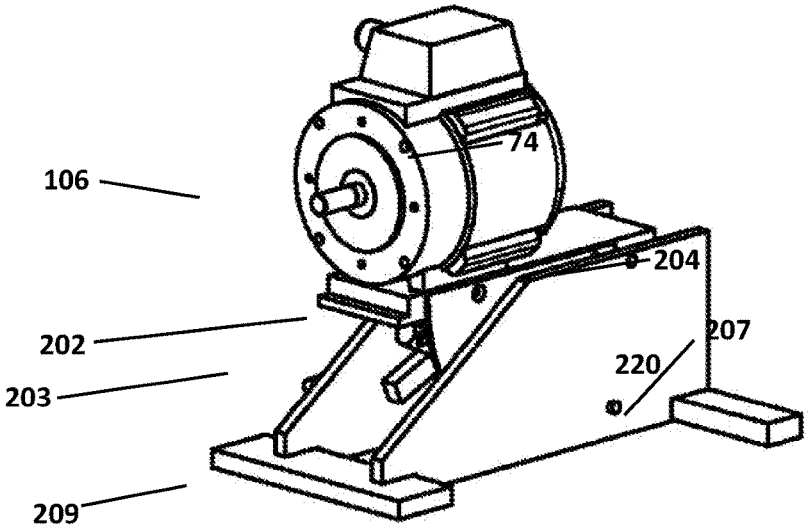
FIG. 20B is left perspective view of a motor on an alternate hinging base in a lowered position.

FIGS. 20A and 20B show the hinged downward motion-damping motor base 220 and hinged left and right supports 201, 202 in a lowered position. In this lowered position the orientation of the motor 74 and the axle 106 are such that a grinding disc attached to the axle 74 is roughly perpendicular to worktable or bench upon which the invention is mounted. This lowered position orients the frontal plane of the grinding disc at approximately 90 degrees from the surface of the worktable or bench.

Figure 21A:
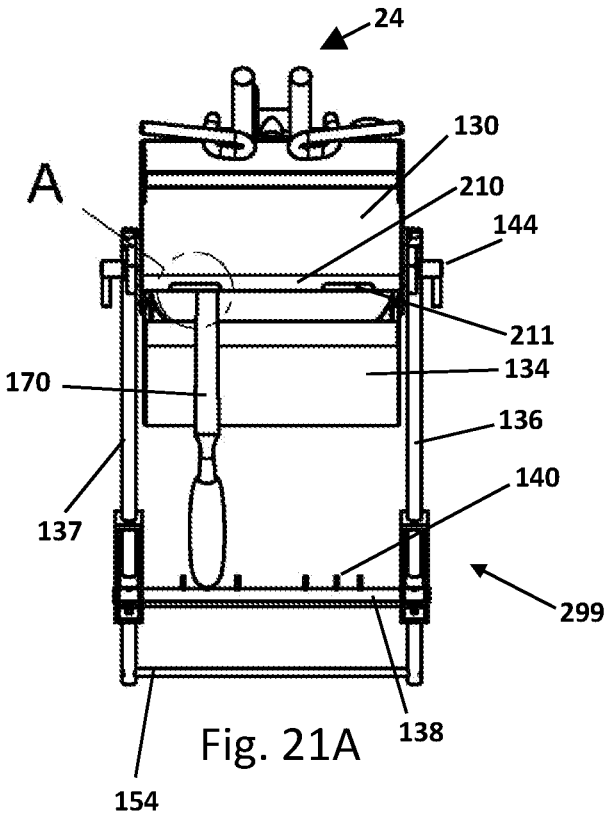
FIG. 21A is a front view of an example tool sharpening accessory with an example tool height alignment sighting surface, with cutout, incorporated into a top dust flap for use in conjunction with the example tool sharpening accessory.

FIG. 21A shows a front view of an example tool sharpening accessory with an example tool height alignment sighting surface 210, with cutout 211, incorporated into a top vacuum collector 130 for use in conjunction with the example tool sharpening accessory. The tool sharpening accessory can also include, in some embodiments, a bottom shield 134 that prevents inadvertent contact with the sharpening disc when a user is sharpening tools.

A plurality of pins 140 are located on a tool holding rod 138 that accommodate a tool 170 that is being sharpened. The pins 170 can be used to hold the tool 170 in place or provide a point of contact to stabilize the tool 170. The tool holding rod 138 is attached to the tool sharpening accessory by way of a first arm 136 and a second arm 137 that allow the rod 138 to be slid toward or away from the sharpening disc. The movement of the rod 138 allows tools of different sizes to be sharpened as well as providing for the proper positioning of the tool 170 in relation to the sharpening disc.

Figure 21B:
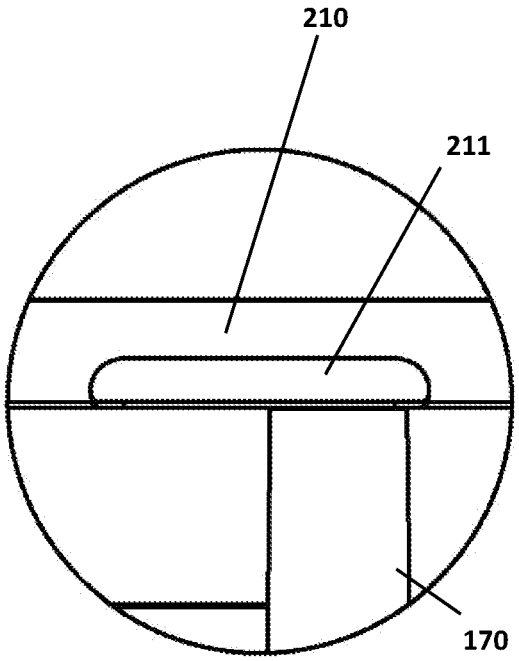
FIG. 21B is a detail view of an example tool sharpening accessory with an example tool height alignment sighting surface, with cutout, incorporated into a top dust flap for use in conjunction with the example tool sharpening accessory.

FIG. 21B shows a detail view of the tool height alignment sighting surface 210 with cutout 211 and a tool 170 placed under the cutout 211 so that it may be properly positioned during sharpening. In some embodiments, the plane of the tool height alignment surface 210 is aligned with the plane of the tool support (299). This causes tools 170 placed along the bottom of the height alignment surface 210 to be positioned near to the centerline of the axis of rotation of the invention. This further causes the tool 170 being sharpened to be oriented as closely to 90 degrees from the direction of the disc's rotation as possible. That is, the sharpening motion of the disc is approximately from the top of the tool to the bottom, or vice versa depending on the side of the disc that the tool 170 is positioned on.

Figure 22A:
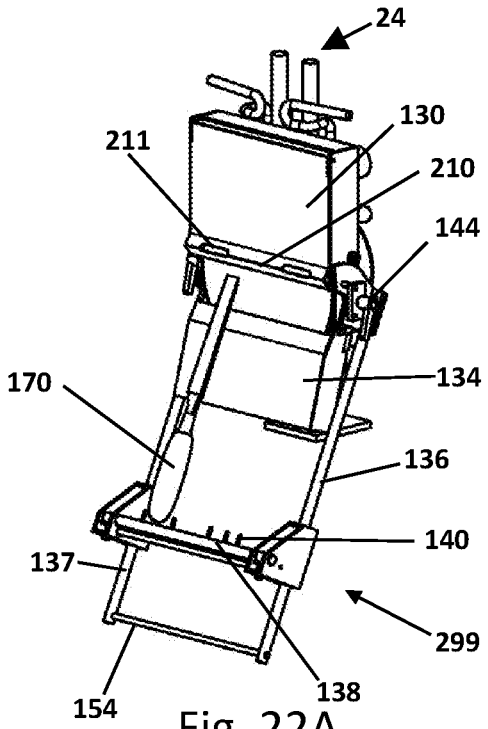
FIG. 22A is a front perspective view of the example tool sharpening accessory with a tool height alignment sighting surface, with cutout, and positioning of a tool to be sharpened from the side of the example tool sharpening accessory.

FIG. 22A is a front perspective view of the example tool sharpening accessory 60 and positioning of a tool 170 to be sharpened from the bottom of the example tool sharpening accessory 60. This embodiment of the tool sharpening accessory 60 includes an example tool height alignment sighting surface 210 with cutouts 211 above the alignment sighting surface 210. The top of the tool height alignment surface 210 is aligned with the plane tool support (299). It can be seen from this view how the tool to be sharpened 170 lays at an angle to the sharpening disc. The cutouts 211 allow a user to have a top-down view of the tool 170 so that it may be positioned accurately.

Figure 22B:
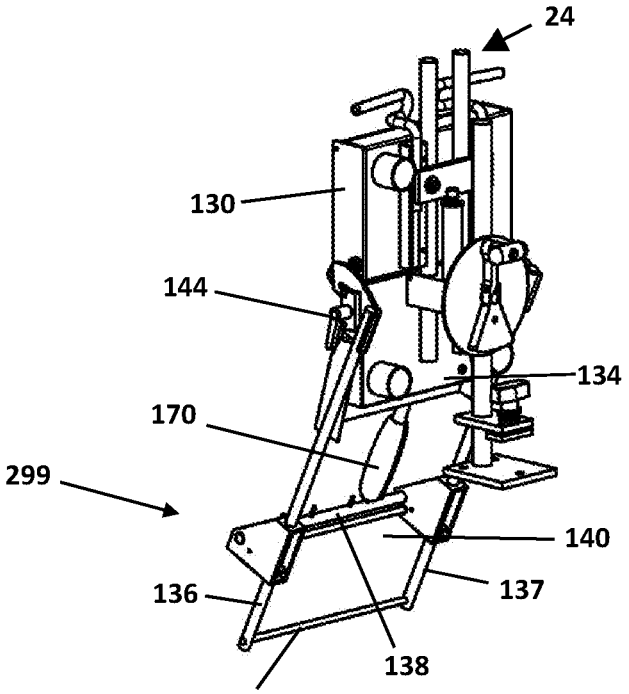
FIG. 22B is a rear perspective view of the example tool sharpening accessory with a tool height alignment sighting surface, with cutout, and positioning of a tool to be sharpened from the side of the example tool sharpening accessory.

FIG. 22B shows a rear perspective view of the example tool sharpening accessory 60 and positioning of a tool 170 to be sharpened from the bottom of the example tool sharpening accessory 60. This embodiment of the tool sharpening accessory 60 may also include a top vacuum collector 130 formed by a movable cover and side enclosures. The tool sharpening accessory 60 may also include a bottom shield 134 to prevent inadvertent contact with the disc 90 during sharpening operations. The tool holding rod 138 may be moved up and down the first and second arms 136, 137. The tool holder may also be rotated to and from the disc 90 to change the angle of sharpening by adjusting the mounting brackets with adjustment knob 144.

Accordingly, a tool sharpening accessory 60 for a grinder tool 10A, 10B includes a first arm 136 extending in a first direction and a second arm 137 extending parallel in the first direction and the first and second arms 136, 137 opposite opposing sides of the grinder tool. A tool holding rod 138 extends between the first arm 136 and the second arm 137. The tool holding rod 138 includes a set of pins 140 located at predetermined positions for interfacing to a tool 170 to be sharpened. The tool holding rod 138 is configured to be adjustable in the first direction.

To ease proper positioning of a tool 170, the tool sharpening accessory 60 may include an alignment aid 160 having an indicator 210 to align an end of the tool 170 on a disc when the tool holding rod 138 is adjusted. Finally, the tool sharpening accessory 60 may also include a vacuum collector 130 between the first arm 136 and the second arm 137 to collect waste material and grinder surface grit.

The tool sharpening accessory 60 may be used to improve productivity and efficiency when using a grinder tool to sharpen a wood working or another hand tool 170. The tool sharpening accessory 60 allows for multiple positioning of a tool surface to the disc surface to ensure fast and effective sharpening and ability to sharpen various wood cutting, curved, flat-bladed, or other tool surfaces.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document. For irreconcilable inconsistencies, the usage within this document controls.

While the claimed subject matter has been particularly shown and described regarding the foregoing examples, those skilled in the art will understand that many variations may be made therein without departing from the intended scope of subject matter in the following claims. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A grinder tool with blind mounting of a disc, comprising:

a center alignment mechanism including a plate having a recessed opening having a first contact and a second contact, the recessed opening larger than a diameter of the disc;

a rotational device including an axle and movable with respect to the center alignment mechanism; and a hub mounted to the axle including a first coupling interface, wherein the disc has a second coupling interface for mating with the first coupling interface, wherein the plate of the center alignment mechanism is movable a mounting distance relative to the hub to contact the disc at the first contact and the second contact of the recessed opening to center and vertically align the first coupling interface with the second coupling interface, and wherein the rotational device is to rotate the hub to angle align the first coupling interface with the second coupling interface to allow the disc to mate flatly with and attach to the hub.

2. The grinder tool of claim 1 wherein the disc is ferromagnetic, and the hub is magnetic.

3. The grinder tool of claim 1 wherein the disc and the hub have a non-magnetic mechanical latching system.

4. The grinder tool of claim 1 wherein the rotational device is a hand crank.

5. The grinder tool of claim 1 wherein the rotational device is a motor and the motor is coupled to a motor controller having a mounting mode activatable by a user, the mounting mode to slowly rotate the motor to allow the first coupling interface to angle-align with the second coupling interface.

6. The grinder tool of claim 1 wherein the plate includes a set of vacuum openings and an opposing cover spanning a portion of the recessed opening, the opposing cover includes a first recessed channel extending from the first contact and the second contact to the set of vacuum openings and wherein when at least one of the set of vacuum openings is coupled to a vacuum source, the first recessed channel forms a vacuum cavity for collecting and removing material from the tool.

7. The grinder tool of claim 6 wherein the plate includes a second recessed channel extending around the recessed opening and extending towards the first recessed channel to extend the vacuum cavity.

8. The grinder tool of claim 1 further comprising a ledge within the recessed opening wherein the ledge is configured to prevent the disc from being tipped when a force is applied to a face of the disc thereby preventing the first coupling interface to unmate from the second coupling interface.

9. The grinder tool of claim 1 further comprising a demounting lever attached to the plate biased in a first position not in contact with a backside of the disc and movable to a second position to contact the backside of the disc to tip the disc to allow the first coupling interface to unmate from the second coupling interface in the disc and to further allow a user to grab the disc.

10. The grinder tool of claim 1 further comprising a work shelf adjustable in multiple angles from a normal in the orthogonal direction to the disc and the work shelf adjustable toward and away from the disc.

11. The grinder tool of claim 10 wherein the work shelf is couplable to a magnetic fence, comprising:

a first portion with a screw mount to extend in a direction normal to a top surface the first portion, the first portion to magnetically couple to a side edge of the work shelf;

a second portion having an elongated opening to encircle the screw mount and to adjust about a rotational axis around the screw mount and adjust in a linear direction back and forth along the elongated opening, the second portion to magnetically couple to a top side of the work shelf; and a tightening screw knob on the screw mount to clamp the second portion once positioned.

12. The grinder tool of claim 10 wherein the work shelf is couplable to a fence, comprising:

a first fence clamp to fasten the fence the work shelf;

a screw mount extending in a direction normal to the top surface of the work shelf, and a second fence clamp having a channel guide and first and second opposing surfaces extending normal from the screw mount and the first opposing surface having a first height from the center of the channel guide and the second opposing surface having a different second height from the center of the channel guide;

a first elongated portion with a thickness about the height of the first height;

a second elongated portion with a thickness about the height of the second height;

wherein the first and second elongated portions include a channel to couple to a respective side of the channel guide, wherein the second fence clamp is adjustable in a rotational axis around the screw mount and the first and second elongated portions are to adjust in a linear direction back and forth along the channel, the screw mount accepting a tightening screw knob to clamp the first or second elongated portion once positioned on the work shelf.

13. The grinder tool of claim 1 further comprising:

a table mount having a set of rods extending in a direction orthogonal to a table surface and wherein the plate and rotational device are mounted to the set of rods to allow up and down positioning;

a tool sharpener attached to the plate, the tool sharpener comprising:

a first arm extending in a first direction;

a second arm extending parallel in the first direction and the first and second arms opposite opposing sides of the disc; and a tool holding rod extending between the first arm and the second arm, the tool holding arm having a set of pins located at predetermined positions for interfacing with a tool to be sharpened, the tool holding rod adjustable along the first direction.

14. The grinder tool of claim 13 wherein the tool sharpener further comprises a pair of mounting brackets each attached to the first arm and the second arm separately, wherein the mounting brackets allow the tool sharpener to be rotatable around an axis when the tool sharpener is mounted to the grinder tool.

15. The grinder tool of claim 14 wherein the mounting brackets are shaped to allow the tool to be sharpened to approach the disc in a direction along the plane of the disc from a side of the grinder tool.

16. The grinder tool of claim 13 wherein the tool holding rod includes two binding plates each having an opening encircling a respective first arm and a second arm, wherein when the two binding plates are in a first position, they are biased to contact the first and second arms to maintain position of the tool holding rod, and wherein the two binding plates are in a second position, the two binding plates are positioned to allow the tool holding rod to be adjusted along the first direction.

17. The grinder tool of claim 13 wherein the tool holding rod includes a binding plate release bar parallel to the tool holding rod and connected to the two binding plates.

18. The grinder tool of claim 13 wherein the two binding plates are separately biased with a spring, and each has a lever to allow de-biasing of the spring.

19. A method for blind mounting a disc with a first coupling interface to a grinder tool, comprising:

mounting a rotational device having an axle to a center alignment mechanism including a plate having a recessed opening having a first contact and a second contact, the recessed opening larger than a diameter of the disc, the first contact and the second contact movable in a direction with respect to the rotational device;

mounting a hub to the axle to create a second coupling interface;

inserting the disc into the recessed opening;

moving the plate a mounting distance with respect to the hub to contact the disc at the first contact and the second contact of the recessed opening to center and vertically align the first coupling interface to the second coupling interface; and rotating the rotational device to angle align the first coupling interface with the second coupling interface to allow the disc to mate flatly with and attach to the hub.

20. The method of claim 19 further comprising:

creating a set of vacuum openings in the plate;

creating a first recessed channel in an opposing top cover extending from the first contact and the second contact to the set of vacuum openings in the plate.

21. The method of claim 20 further comprising creating a second recessed channel in the plate extending around a recessed opening in the plate where the disc is mounted and extending towards the first recessed channel.

22. A method for blind loading a ferromagnetic disc onto a grinder tool, comprising:

inserting the disc with a first coupling interface into a recessed opening of a plate attached to a rotational device coupled to a hub with a second coupling interface;

moving the plate a mounting distance to contact the disc at a first contact and a second contact of the recessed opening to center and vertically align the first coupling interface to the second coupling interface;

rotating the rotational device slowly to further align the first coupling interface to the second coupling interface to allow the disc to mate flatly with the hub; and moving the plate back opposite the mounting distance.

23. The method of claim 22 further comprising:

moving a demounting lever attached to the plate to a first position to allow the disc to decouple from the hub.

* * * * *